US011298843B2

(12) United States Patent
Kopelas et al.

(10) Patent No.: US 11,298,843 B2
(45) Date of Patent: Apr. 12, 2022

(54) SHAVING CARTRIDGES PIVOTABLE ABOUT TWO AXES

(71) Applicant: BIC-VIOLEX SA, Attiki (GR)

(72) Inventors: Panagiotis Kopelas, Dafni-Athens (GR); Dimitrios Efthimiadis, Nea Kypseli (GR)

(73) Assignee: BIC-VIOLEX SA, Attiki (GR)

( * ) Notice: Subject to any disclaimer, the term of this patent is extended or adjusted under 35 U.S.C. 154(b) by 0 days.

(21) Appl. No.: 16/478,522

(22) PCT Filed: Jan. 10, 2018

(86) PCT No.: PCT/EP2018/050594
§ 371 (c)(1),
(2) Date: Jul. 17, 2019

(87) PCT Pub. No.: WO2018/134103
PCT Pub. Date: Jul. 26, 2018

(65) Prior Publication Data

US 2019/0337174 A1 Nov. 7, 2019

(30) Foreign Application Priority Data

Jan. 17, 2017 (EP) ..... 17151794
Jan. 17, 2017 (EP) ..... 17151799

(51) Int. Cl.
*B26B 21/52* (2006.01)
*B26B 21/06* (2006.01)
*B26B 21/22* (2006.01)

(52) U.S. Cl.
CPC ..... *B26B 21/521* (2013.01); *B26B 21/06* (2013.01); *B26B 21/225* (2013.01)

(58) Field of Classification Search
CPC ..... B26B 21/00; B26B 21/14; B26B 21/16; B26B 21/22; B26B 21/225; B26B 21/40; B26B 21/4012; B26B 21/52; B26B 21/521
(Continued)

(56) References Cited

U.S. PATENT DOCUMENTS 2,119,792 A 6/1938 Parkin
3,935,639 A 2/1976 Terry et al.
(Continued)

FOREIGN PATENT DOCUMENTS

DE 102013213881 1/2015
EP 1245351 10/2002
(Continued)

OTHER PUBLICATIONS

Non-Final Office Action dated Oct. 14, 2020 in related U.S. Appl. No. 16/478,527, 22 pages.
(Continued)

*Primary Examiner* — Jason Daniel Prone
(74) *Attorney, Agent, or Firm* — Ohlandt, Greeley, Ruggiero and Perle, LLP

(57) ABSTRACT

A connector for attaching a cartridge to a handle. The connector is adapted to rotate around a rocking axis with respect to the handle. The connector includes a pair of arms adapted to attach the connector to the cartridge, a holder adapted to attach the connector to the handle, and at least a pair of resilient lateral tongues protruding from the connector and positioned symmetrically with regard to a connector axis. One of the lateral tongues is adapted to flex when the connector is rotated in a first direction around the rocking axis, and the other lateral tongue is adapted to flex when the connector is rotated in a second direction around the rocking axis.

8 Claims, 13 Drawing Sheets

(58) Field of Classification Search
USPC ..... 30/47–51, 526, 527
See application file for complete search history.

(56) References Cited

U.S. PATENT DOCUMENTS

| | | | | | |
|---|---|---|---|---|---|
| 3,950,848 | A * | 4/1976 | Goldstein | B26B 21/225 | 30/47 |
| 3,950,849 | A * | 4/1976 | Perry | B26B 21/225 | 30/47 |
| 3,964,160 | A * | 6/1976 | Gordon | B26B 21/52 | 30/531 |
| 4,152,828 | A * | 5/1979 | Lund | B26B 21/225 | 30/529 |
| 4,403,414 | A * | 9/1983 | Kiraly | B26B 21/225 | D28/46 |
| 4,475,286 | A * | 10/1984 | Saito | B26B 21/225 | 30/50 |
| 4,879,811 | A * | 11/1989 | Cooney | B26B 21/52 | 30/527 |
| 5,029,391 | A | 7/1991 | Althaus et al. | | |
| 5,038,472 | A * | 8/1991 | Iderosa | B26B 21/225 | 30/527 |
| 5,050,301 | A * | 9/1991 | Apprille, Jr. | B26B 21/225 | 30/529 |
| 5,953,824 | A * | 9/1999 | Ferraro | B26B 21/225 | 30/527 |
| 6,115,924 | A | 9/2000 | Oldroyd | | |
| 6,381,857 | B1 | 5/2002 | Oldroyd | | |
| 6,615,498 | B1 * | 9/2003 | King | B26B 21/225 | 30/527 |
| 7,137,205 | B2 * | 11/2006 | Royle | B26B 21/225 | 30/527 |
| 7,461,456 | B2 * | 12/2008 | Tsushio | B26B 19/048 | 30/527 |
| 7,461,458 | B2 | 12/2008 | Peyser et al. | | |
| 7,526,869 | B2 | 5/2009 | Blatter et al. | | |
| 8,151,472 | B2 * | 4/2012 | Dimitris | B26B 21/225 | 30/527 |
| 8,732,965 | B2 | 5/2014 | Efthimiadis et al. | | |
| 8,745,882 | B2 * | 6/2014 | Murgida | B26B 21/521 | 30/527 |
| 8,745,883 | B2 | 6/2014 | Murgida et al. | | |
| 8,898,909 | B2 * | 12/2014 | Schmitt | B26B 19/048 | 30/527 |
| 9,469,038 | B2 * | 10/2016 | Iaccarino | B26B 21/225 | |
| 9,522,472 | B2 | 12/2016 | Leicht et al. | | |
| 9,707,688 | B2 * | 7/2017 | Giannopoulos | B26B 21/225 | |
| 9,849,599 | B2 | 12/2017 | Gers-Barlag et al. | | |
| 10,538,007 | B2 * | 1/2020 | Zucker | B26B 21/225 | |
| 10,836,059 | B2 * | 11/2020 | Efthimiadis | B26B 21/4012 | |
| 10,843,357 | B2 * | 11/2020 | Jang | B26B 21/4012 | |
| 10,933,547 | B2 * | 3/2021 | Kopelas | B26B 21/225 | |
| 10,960,561 | B2 * | 3/2021 | Kim | B26B 21/225 | |
| 10,974,403 | B2 * | 4/2021 | Chang | B26B 21/225 | |
| 11,148,310 | B2 * | 10/2021 | Maimone | B26B 21/225 | |
| 11,161,263 | B2 * | 11/2021 | Parmele | B26B 21/521 | |
| 2011/0247217 | A1 * | 10/2011 | Johnson | B26B 21/225 | 30/50 |
| 2012/0073149 | A1 | 3/2012 | Murgida et al. | | |
| 2012/0073150 | A1 | 3/2012 | Murgida et al. | | |
| 2012/0255185 | A1 | 10/2012 | Patel et al. | | |
| 2013/0081290 | A1 | 4/2013 | Murgida et al. | | |
| 2015/0217466 | A1 | 8/2015 | Leicht et al. | | |
| 2018/0021967 | A1 * | 1/2018 | Murgida | B26B 21/225 | 30/527 |
| 2019/0337174 | A1 | 11/2019 | Kopelas et al. | | |
| 2019/0366570 | A1 | 12/2019 | Kopelas et al. | | |
| 2020/0039098 | A1 | 2/2020 | Kopelas et al. | | |
| 2021/0354322 | A1 * | 11/2021 | Kopelas | B26B 21/521 | |

FOREIGN PATENT DOCUMENTS

| | | |
|---|---|---|
| EP | 2508309 | 10/2012 |
| EP | 2902156 | 8/2015 |
| GB | 2096519 | 10/1982 |
| GB | 2116470 | 9/1983 |
| GB | 2463035 | 3/2010 |
| JP | 4-22388 | 1/1992 |
| WO | 93/20983 | 10/1993 |

OTHER PUBLICATIONS

U.S. Non-Final Office Action dated Jul. 31, 2020 in related U.S. Appl. No. 16/478,353, 14 pages.

International Search Report dated Apr. 12, 2018 in related PCT International Patent Application No. PCT/EP2018/050596, 2 pages.

Written Opinion dated Apr. 12, 2018 in related PCT International Patent Application No. PCT/EP2018/050596, 4 pages.

International Search Report dated Apr. 20, 2018 in corresponding PCT International Patent Application No. PCT/EP2018/050594, 2 pages.

Written Opinion dated Apr. 20, 2018 in corresponding PCT International Patent Application No. PCT/EP2018/050594, 5 pages.

International Search Report dated Apr. 12, 2018 in related PCT International Patent Application No. PCT/EP2018/050595, 3 pages.

Written Opinion dated Apr. 12, 2018 in related PCT International Patent Application No. PCT/EP2018/050595, 5 pages.

* cited by examiner

SHAVING CARTRIDGES PIVOTABLE ABOUT TWO AXES

CROSS REFERENCE TO RELATED APPLICATION

This application is the US National Stage Entry Application of International Application PCT/EP2018/050594, filed Jan. 10, 2018, now published as WO/2018/134103 which claims priority to European Applications EP17151799.8 and EP17151794.9, both of which were filed on Jan. 17, 2017, the entire contents of which are incorporated herein by reference.

FIELD

The present disclosure relates to wet shavers comprising a cartridge pivotable about two pivot axes, and especially to shavers including a shaving handle system including connectors adapted to enable pivoting of the cartridge around the two axes. Specifically, the disclosure relates to special types of connectors usable with shaving cartridges wherein the shaving cartridges are capable of pivoting about two distinct axes with respect to the shaver handles.

BACKGROUND

There are well known safety razors where the cartridge is mounted on the handle with freedom to move about a rocking axis, which is transverse to the cutting edge of the cartridge or is mounted for movement about an axis parallel with the cutting edge of the cartridge.

Oftentimes, the handle may include a yoke member and a spring adapted for biasing the yoke member to a central position, and also deforming resiliently to permit rocking of the cartridge about the rocking axis.

SUMMARY

The present disclosure involves a connector for attaching a cartridge to a handle. The connector is adapted to rotate around a rocking axis with respect to the handle. The connector comprises at least a pair of arms adapted to attach the connector to the cartridge, a holder adapted to attach the connector to the handle, and at least a pair of resilient lateral tongues protruding from the connector and positioned symmetrically with regard to a connector axis. One of the lateral tongues is adapted to flex when the connector is rotated in a first direction around the rocking axis, and at least another of the other o lateral tongues is adapted to flex when the connector is rotated in a second direction around the rocking axis.

Many modern wet shavers have connectors facilitating the cartridge to pivot around an axis parallel with blades. Some shavers provide connectors additionally enabling the cartridge to rotate about a second axis. The mechanisms adapted to allow for such rotation around the second axis are rather complex and could be complicated to manufacture.

The present disclosure introduces a connector which connects the cartridge with the handle in a simple manner, thus allowing the shaver to be manufactured in large numbers in a short time with minimum costs, thereby saving of material in the process. The connector includes at least two lateral tongues which generate biasing forces to urge the connector back into its non-rotated position as the connector rotates about the rocking axis. The at least two lateral tongues are independent of each other to ensure smooth rotation of the connector (and cartridge).

Further embodiments of the connector may include one or more of the following additional features:

each lateral tongue comprises at least a curved section, such that the curved section is adapted to stretch into a linear shape during flexing of the lateral tongue;

the lateral tongues are substantially U-shaped;

the connector is adapted to rotate in the first and second directions until reaching an end rotated position, and wherein at the end rotated position of the connector both lateral tongues are adapted to be elastically deformed simultaneously;

the connector comprises a central tongue extending along the connector axis, where the pair of elastic tongues is integrally formed with the central tongue;

the central tongue, when flexed, generates a return torque between 0 Nmm and 30 Nmm;

the curved section of each lateral tongue, when flexed, is stretched into a linear shape extending along a line which forms an angle between 0-30 degrees with the connector axis;

the connector is made of plastic;

at least the lateral tongues are made of metal.

A shaver comprising the connector according to one of the above embodiments may be designed such that the shaver comprises a cartridge coupled with the arms of the connector, and a handle coupled with the holder of the connector and optionally such that:

the connector is permanently attached to the handle;

the connector is removably attached to the handle;

the connector is fixedly connected to the cartridge;

the connector is releasably connected to the cartridge.

At the same time, there is contemplated a novel shaving handle system for holding a cartridge, which could be implemented with the above described connector in accordance with the detailed description and FIGS. 11, 12A, 12B.

Alternatively, a shaving handle system may comprise a handle extending longitudinally along a longitudinal handle direction between a proximal end and a distal end. The shaving handle system comprises a connector adapted to rotate around a rocking axis with respect to the handle, the connector comprising two lateral tongues extending forwardly from the proximal end of the handle. The handle comprises a deflecting means for flexing either one of the lateral tongues. The lateral tongues are abutting the deflecting means, such that when the connector is rotated in a first direction around the rocking axis with respect to the handle, one of the two lateral tongues is flexed by the deflecting means, and such that when the connector is rotated in a second direction around the rocking axis with respect to the handle, the other of the two lateral tongues is flexed by the deflecting means.

Further embodiments of the above defined shaving handle system may include one or more of the following additional features:

the shaving handle system further comprises an elongated support and a pair of hooks, the elongated support and the pair of hooks extending from the proximal end of the handle for movably attaching the connector to the handle; the way how the connector and the handle are connected to each other improves the quality of the sliding movement of the connector with respect to the handle, since the less parts are present to obstruct such movement, the more fluent the movement appears to be; also, with the more complex structural alternatives known from the field of shavers, there exists a high degree of probability that hair debris and water may gather in some parts of the product; this is largely avoided by the constructional simplicity of the above mentioned shaving handle system in that it allows the shaver to be properly rinsed; wherein:

the handle has an upper face and a lower face, the upper face being opposite to the lower face, wherein the elongated support extends from the lower face and the hooks extend from the upper face. In this shaving handle system, the elongated support and the pair of hooks are adapted to reliably hold the connector in position and allowing it to rotate in an unobstructed fashion; the position of the elongated support at the lower face of the handle and the pair of hooks at the upper face of the handle ensures steady position of the connector with respect to the handle on one hand, and smooth rotation of the connector with respect to the handle on the other hand; one purpose of the present disclosure is to ensure smooth unobstructed rotational movement of the cartridge about the axes both from and into a neutral position; both these goals are achieved by simple structural features;

the connector comprises a pair of elongated arms, each arm having an end, wherein a pivot axis is parallel to the line connecting the end of the arms, whereas the rocking axis is transverse to the line connecting the ends of the arms, the connector being movably attached along the rocking axis to the handle; with this configuration of the two axes around which the cartridge moves, the above attachment of the connector to the handle is especially effective; the movement of the cartridge about the pivot axis can be achieved by use of shell bearings, while the movement of the cartridge about the rocking axis can be achieved by swivelling connector; thereby, the two rotational movements are independent of each other and less complex; reducing complexity of the structure in this way leads to smoother movement; wherein:

the connector is movable along the rocking axis between a first end position and a second end position;

each of the arms comprises a bearing structure;

the pivot axis and the rocking axis intersect each other; such mutual orientation of axes offers more comfortable shaving compared to other orientations;

the proximal end of the handle comprises an oval depression, and the connector is provided with an arcuate face matching side to side with the shape of the oval depression, the arcuate face of the connector being adapted to rock along the oval depression of the handle around the rocking axis transverse to the line connecting the ends of the arms; the oval depression in the handle and the arcuate face of the connector are adapted to maintain constant contact with each other, thus ensuring proper alignment of the individual components during the process of shaving;

the arms extend substantially in a common plane, and the connector comprises a flexible central tongue extending substantially in the same plane as the two arms;

the central tongue and each of the lateral tongues are separated and independent of each other;

the elongated support extends forwardly from the middle of the width of the proximal end of the handle, the support comprising an upwardly protruding block for fixing the connector to the handle, and the deflecting means in the form of a deflector forming the end of the elongated support and being curved in the upward direction;

the shaving handle system comprises two elongated supports extending forwardly from each side of the proximal end of the handle, and the elongated supports each comprise an upwardly protruding step extending along the entire width of the elongated support and adapted to fix the connector to the handle, and the deflecting means in the form of a pin located at the end of the elongated support and protruding in the upward direction;

the connector further comprises reinforcing ribs extending along the length of the arms and towards the center of the connector, the reinforcing ribs being adapted to engage with the steps of the elongated supports, thereby fixing the connector to the handle;

the shaving handle system comprises a stud protruding upwardly from the connector, wherein the connector is adapted to rock from a rest position to the first end position or the second end position, wherein in the first end position the rocking of the connector is stopped by the stud coming into contact with a first of the pair of hooks, and wherein in the second end position the rocking of the connector is stopped by the stud coming into contact with a second of the pair of hooks;

the width of the elongated support taken along the line connecting the ends of the arms is not greater than one third of the width of the proximal end of the handle taken along the line connecting the ends of the arms; this feature aims to provide an increased effectivity and reliability of the attachment of the connector to the handle, while leaving as much space as possible for an unobstructed movement of the connector with respect to the handle; using less material implies less cost in the production, and also less potential friction between the connector and the handle, which could otherwise disrupt the rotational movement; reduced friction may be achieved with various materials, such as plastic materials.

The shaving handle system as defined above is adapted for use in a shaving razor having a cartridge comprising at least one blade having a blade edge extending along a blade edge axis, where according to some embodiments, the shaving razor may comprise one or more of the following features:

the connector of the shaving handle system comprises a pair of elongated arms, each arm having an end, wherein a pivot axis is parallel to the line connecting the end of the arms, whereas a rocking axis is transverse to the line connecting the ends of the arms, the connector being movably attached along the rocking axis to the handle;

the blade edge axis is parallel to the pivot axis;

the cartridge and the connector are attached to each other such that the cartridge and the connector rotate simultaneously around the rocking axis; and the cartridge is pivotally attached to the connector along the pivot axis.

DETAILED DESCRIPTION

The following description of the main embodiments of the present disclosure is made with reference to the accompanying drawings, where the same reference numbers denote identical or similar elements.

Figure 1:
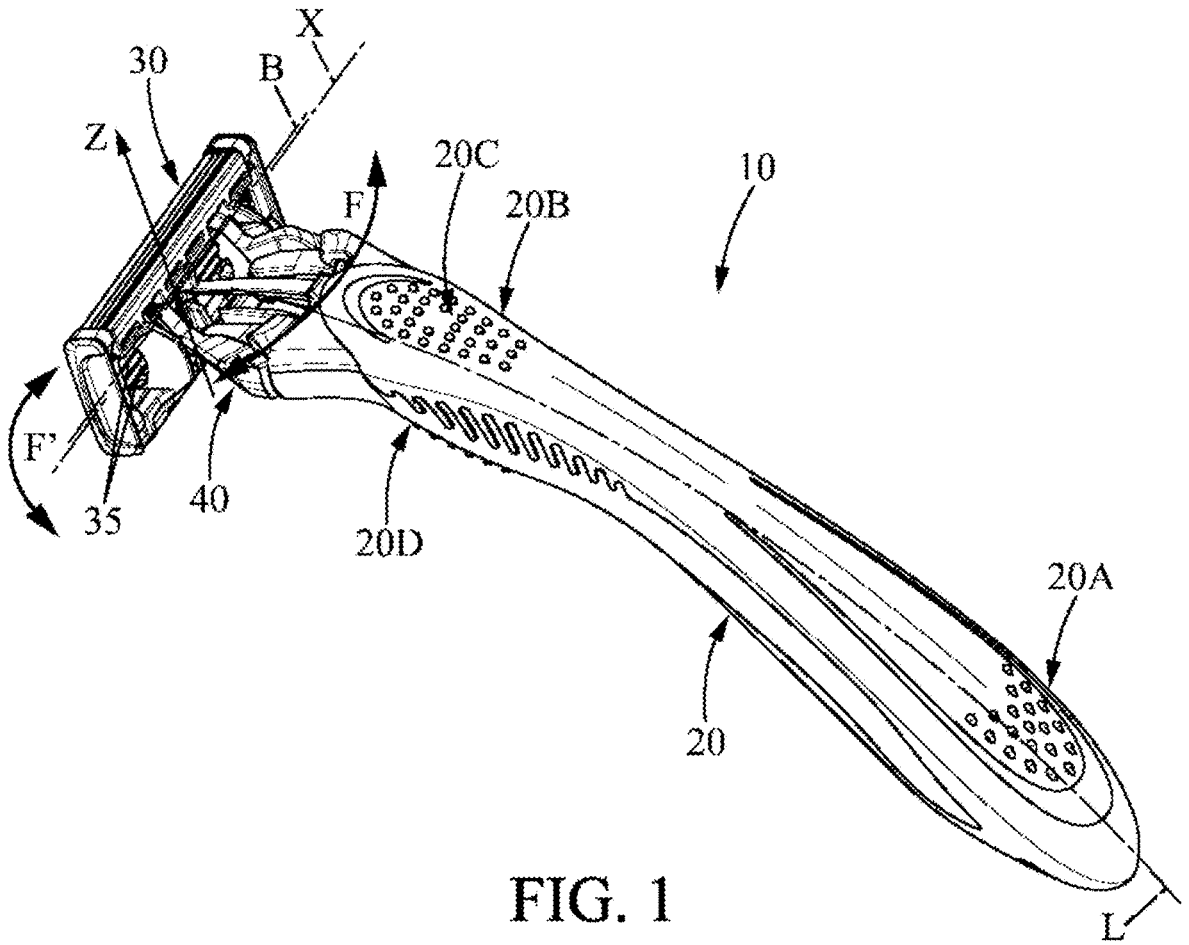
FIG. 1 is an overall view of the shaver according to the present disclosure.
Figure 4A:
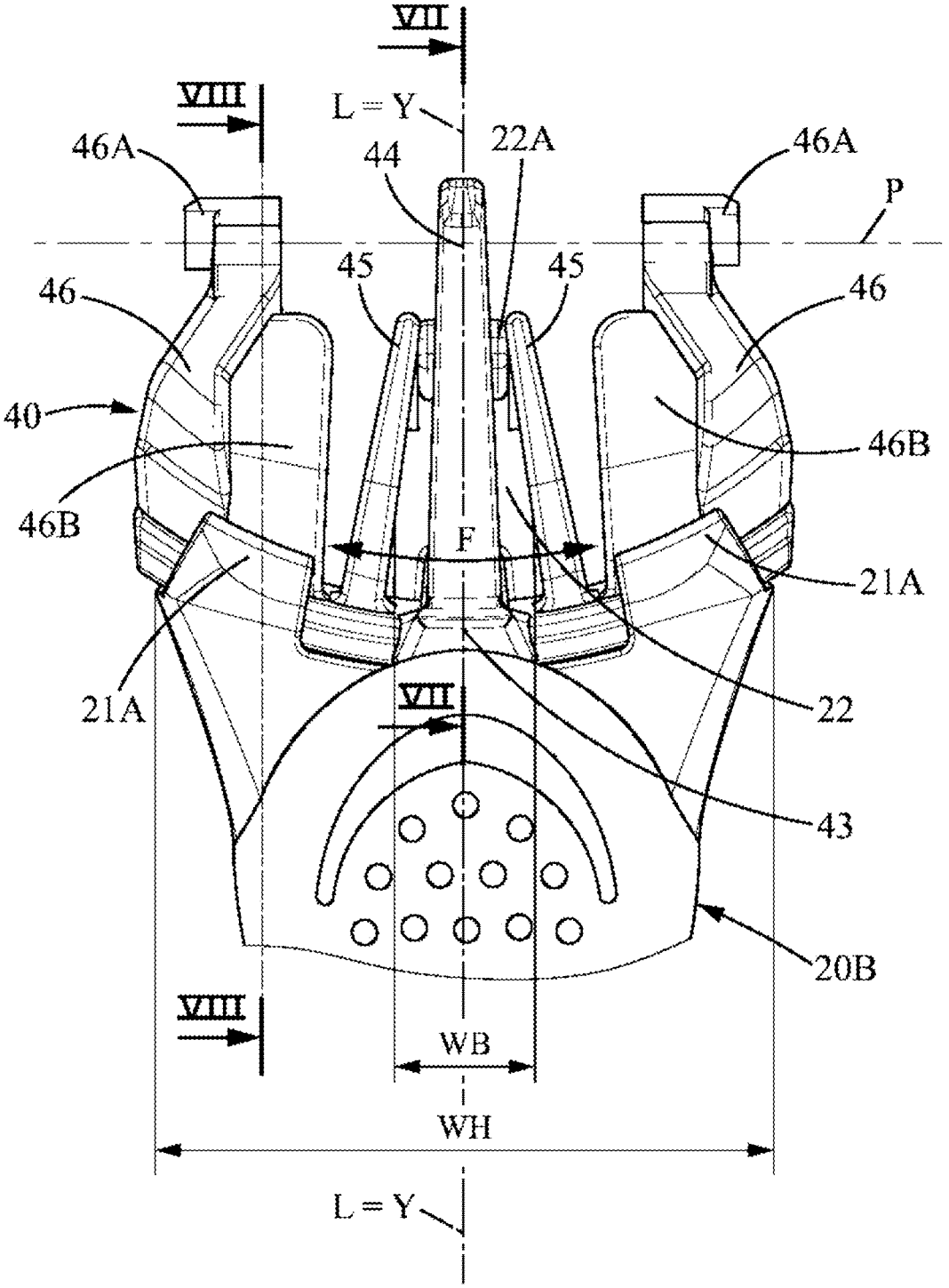
FIG. 4A shows a partial top view of the proximal part of the handle according to the first embodiment with the connector being in the neutral position.
Figure 4B:
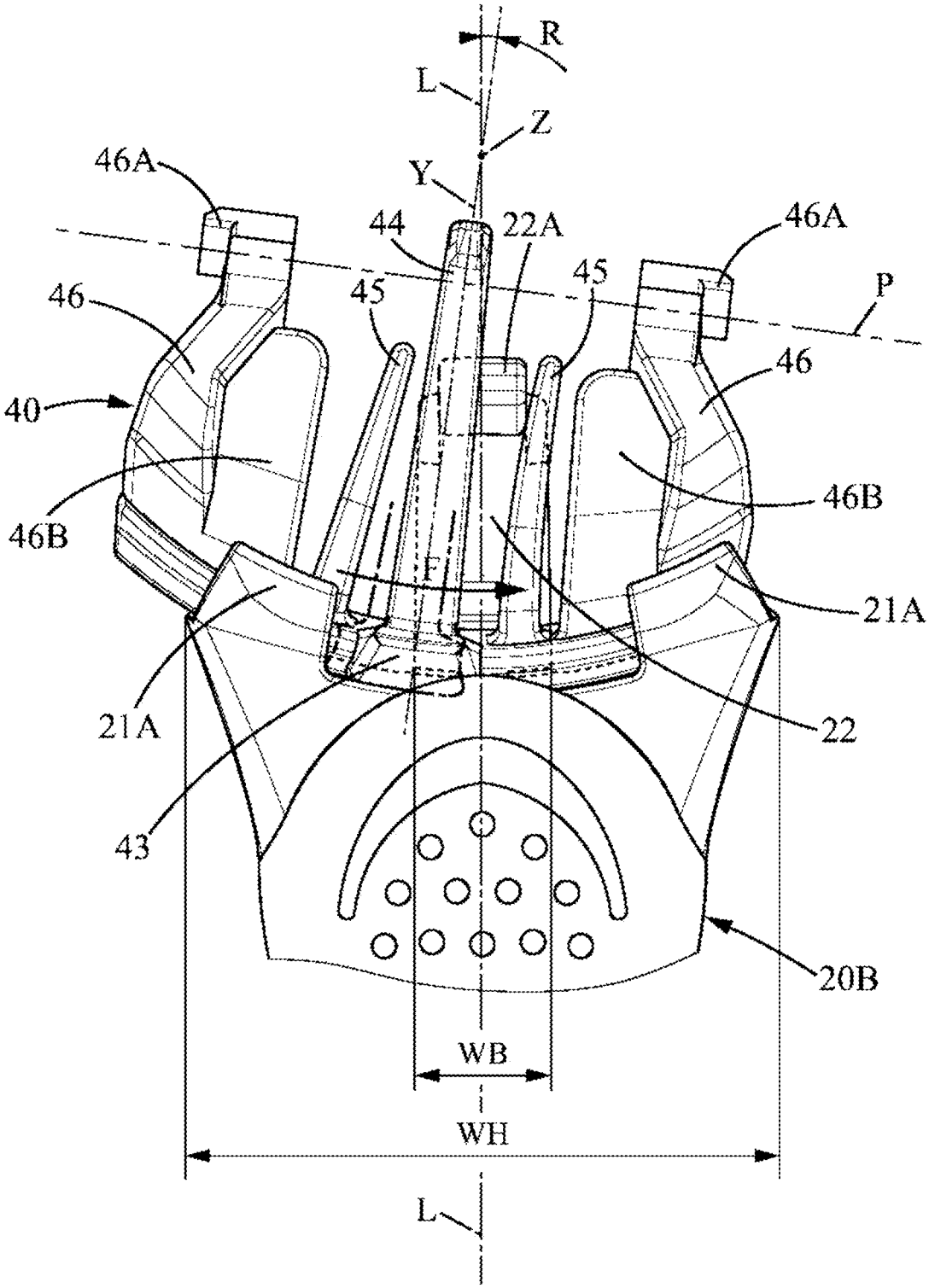
FIG. 4B shows a partial top view of the proximal part of the handle according to the first embodiment with the connector in an end rotated position.
Figure 6:
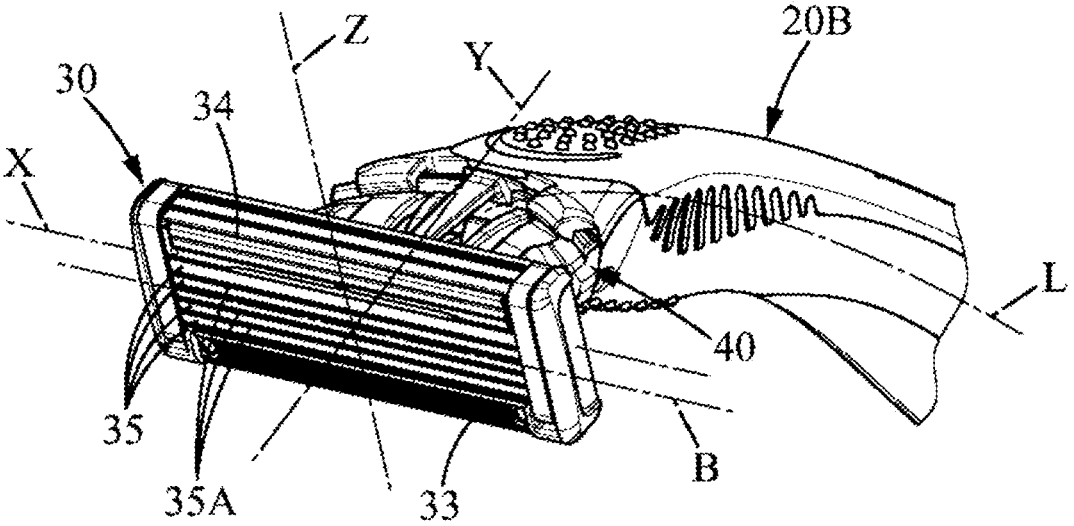
FIG. 6 is a partial perspective view of a possible position of the two pivot axes of the shaver with respect to the blade edge axis (B).

FIG. 1 shows a shaver 10 comprising a handle 20 and having an elongated shape, with a distal end 20A and a proximal end 20B. The handle 20 extends longitudinally along a longitudinal handle direction L between the distal end 20A and the proximal end 20B. The handle 20 further includes a lower face 20D and an upper face 20C. The upper face 20C is opposite the lower face 20D. The handle 20 can have any suitable shape known in the art and can be made from any material, for example metal or plastic. Additional materials may be used on the handle 20 in order to improve the grip of the handle 20 during its use. The handle 20, especially the proximal end 20B of the handle 20, may have a width WH measured between its two sides, as depicted in FIGS. 4A-4B. The width of the handle 20 at its distal end 20A may be different and may also vary along the length of the handle 20. The shaver 10 further comprises a cartridge 30 having an elongated shape and including one or more elongated blades 35 extending along the longitudinal direction of the cartridge 30. Each one of the one or more blades 35 has a blade edge 35A extending along a blade edge axis B, as illustrated in FIG. 6. The longitudinal direction of the cartridge 30 could be identified with the blade edge axis B. The longitudinal direction of the cartridge 30 and the blade edge axis B are generally parallel to each other.

Figure 9:
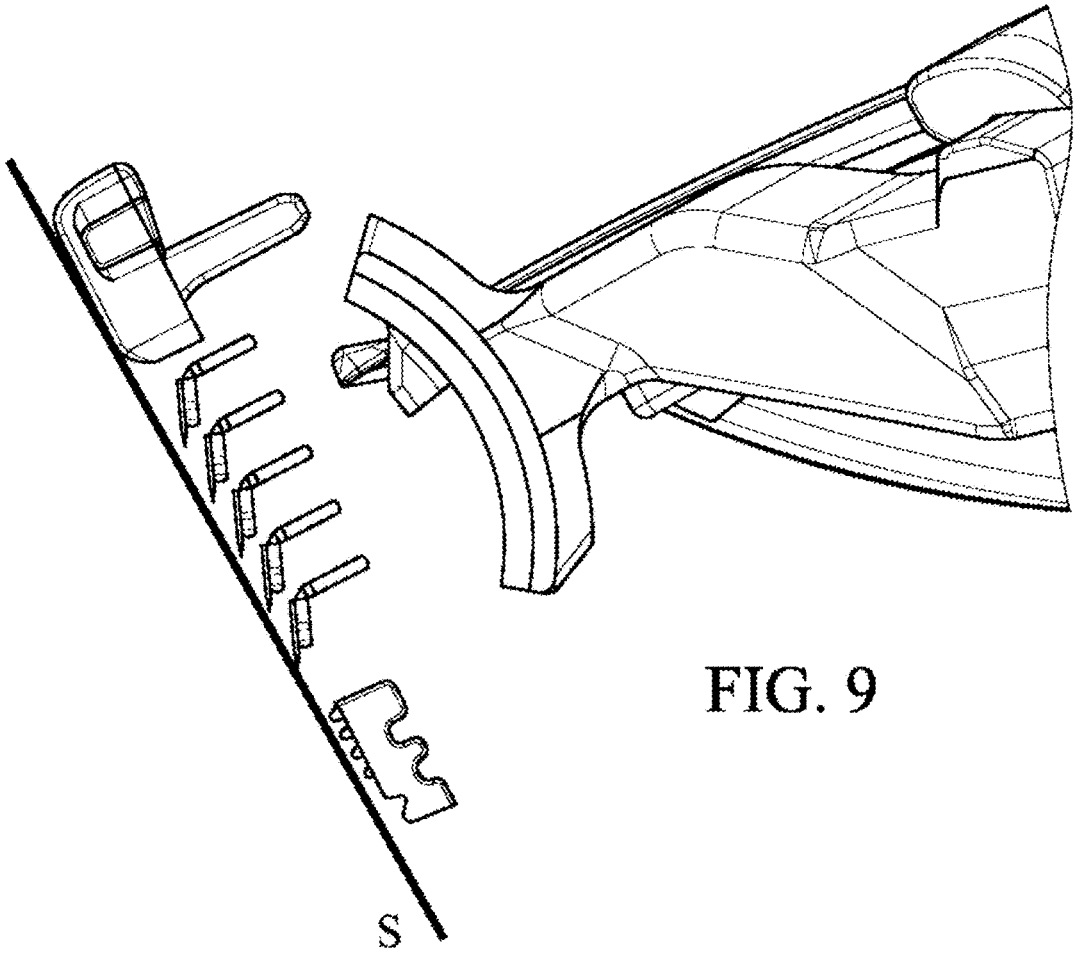
FIG. 9 is illustration defining the term shaving plane S as used in the present disclosure.

As can be also seen in FIG. 6, the cartridge 30 may include a guard 33 and a cap 34 forming skin engaging surfaces. The top surface of the guard 33 and the top surface of the cap 34 are used as general reference for defining a shaving plane. Thus, the shaving plane is defined entirely by the contours of the front side of the cartridge 30 where the blade edges 35A are located. More explicitly, the shaving plane could be defined as illustrated in FIG. 9, i.e. the shaving plane is a plane tangent to the surface of the guard 33 and the surface of the cap 34. The shaving plane does not intersect either the guard 33 or the cap 34 but touches both the guard 33 and the cap 34 at exactly one point of their surfaces. The one or more blades 35 may extend above, in, or below the shaving plane, or may have any other suitable configuration, such as increasing or decreasing exposure. The exposure is equal to the distance measured from the shaving plane to the cutting edge 35A of the blade 35. The shaver 10 further comprises a connector 40 explained in more detail with reference to FIG. 2.

Figure 2:
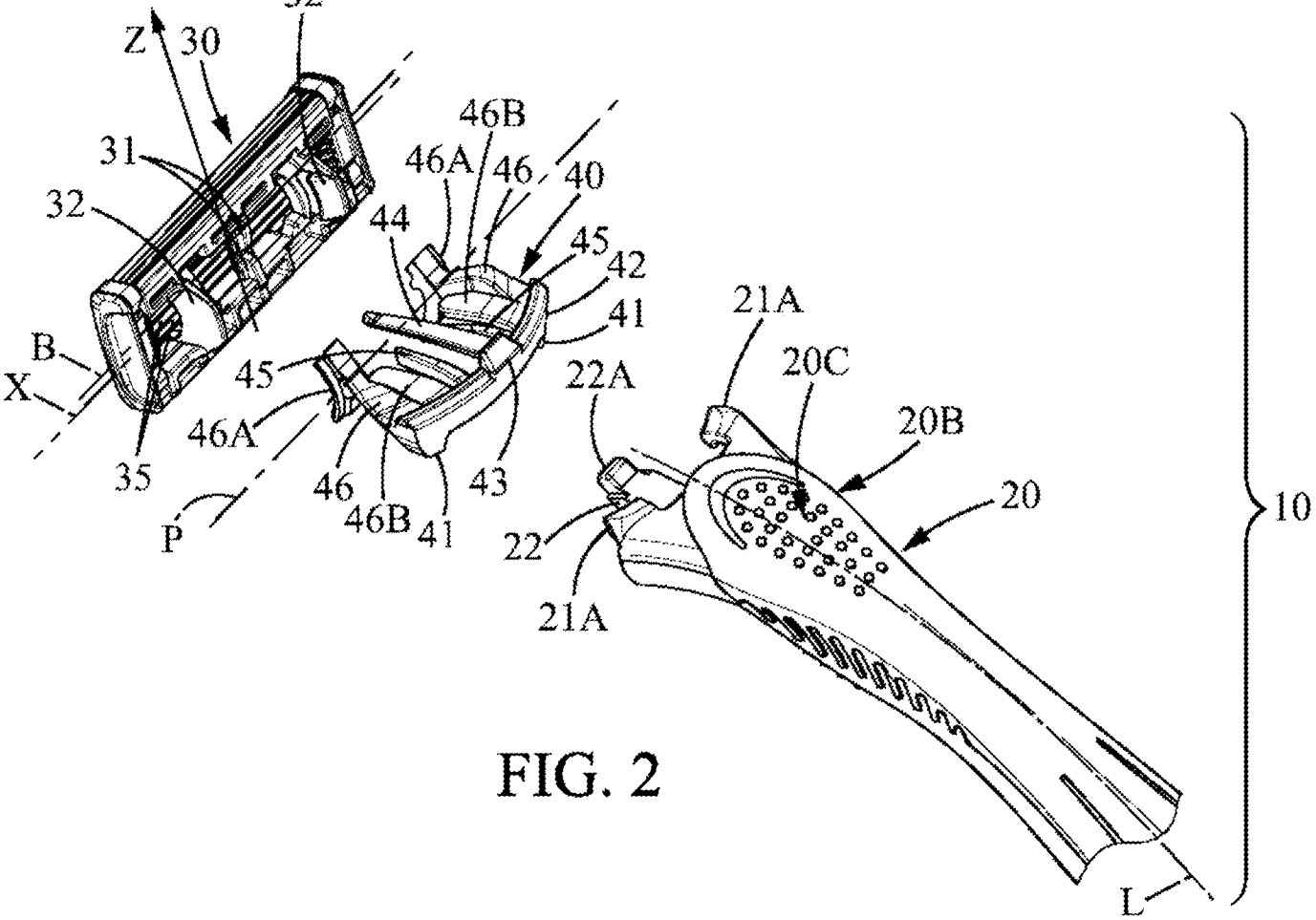
FIG. 2 is a partial exploded view of the components comprised in the shaver of FIG. 1.

As visible in FIG. 2, the cartridge 30 includes a pair of looped hooks 32 adapted to be engaged with shell bearings 46A to enable pivotal movement of the cartridge 30. The looped hooks 32 and the shell bearings 46A can alternatively be replaced by other suitable bearing structures, such as pins and holes. The cartridge 30 is adapted to rotate about a pivot axis X, which can be parallel with one or more blades 35, and especially with the blade edge axis/axes B. The direction of rotation of the cartridge 30 around the pivot axis X is labeled by the double-arrow F' in FIG. 1. Depending on the embodiment, the cartridge 30 can be adapted to rotate in one or both directions illustrated by the arrow F'. As best seen in FIG. 2, the shaver 10 comprises the cartridge 30, the handle 20 and a connector 40. The connector 40 is part of the handle and is positioned between the cartridge 30 and the proximal end of the handle 20B. The cartridge 30, the handle 20 and the connector 40 form three separate elements of the shaver 10, which are assembled together. Specifically, the cartridge 30 is unreleasably attached to the connector 40 and the connector 40 is unreleasably attached to the handle 20. However, configurations where the cartridge 30 is replaceably/releasably attached to the connector 40 and/or where the connector 40 is replaceably/releasably connected to the handle 20 are also possible. Generally, as it will be explained further in the description, the cartridge 30 is movable with respect to the connector 40, and the connector 40 is movable with respect to the handle 20. The handle 20 and the connector 40 are commonly referred to as a shaving handle system. This shaving handle system, as described in the present application, is adapted for holding a cartridge 30. The shaving handle system is further adapted to enable the cartridge 30 to move about two different axes, i.e. to perform pivotal and/or rotational movement with regard to the handle 20.

Figure 5A:
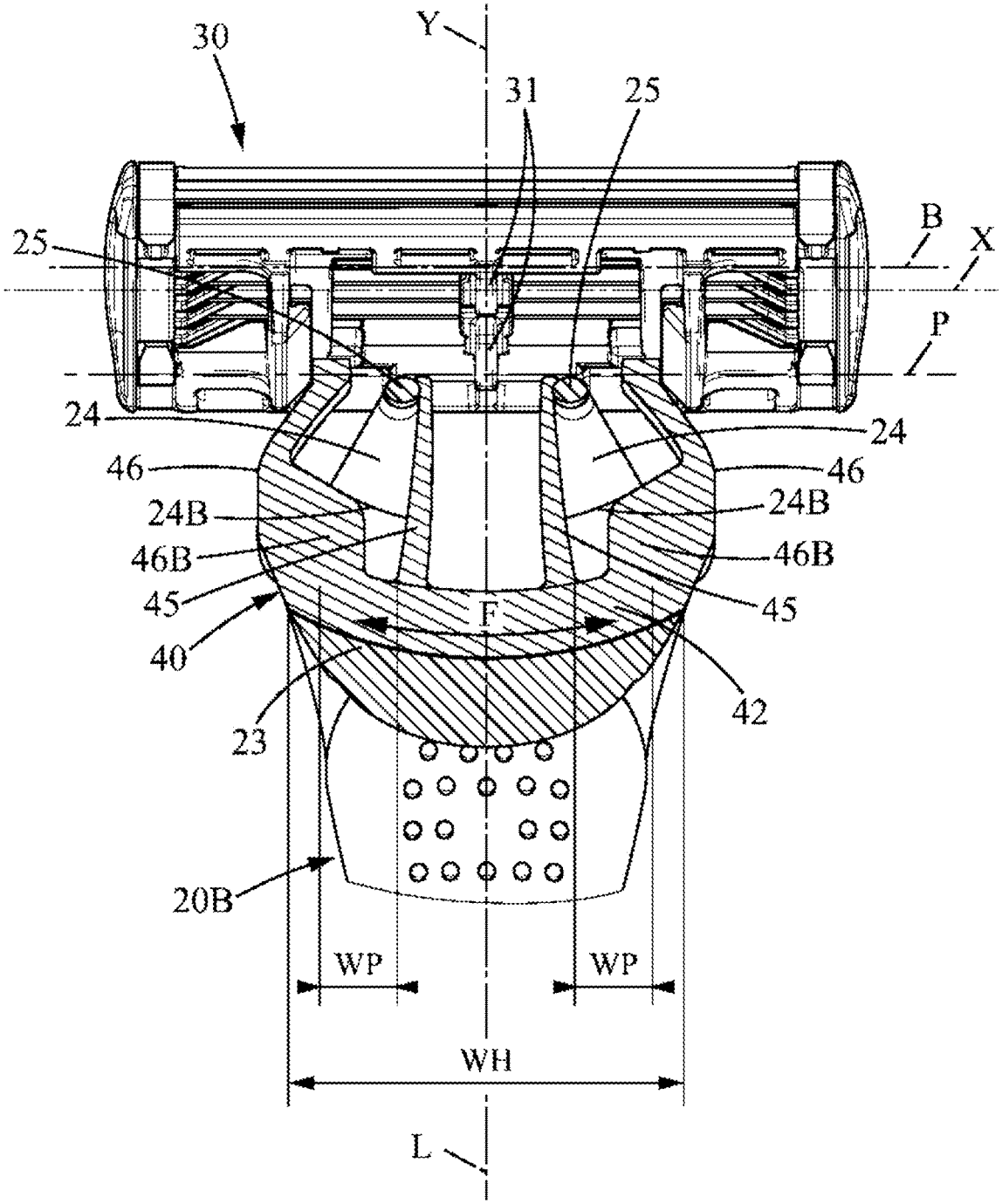
FIG. 5A shows a partial top view of the proximal part of the handle according to the second embodiment with the connector being in the neutral position.
Figure 5B:
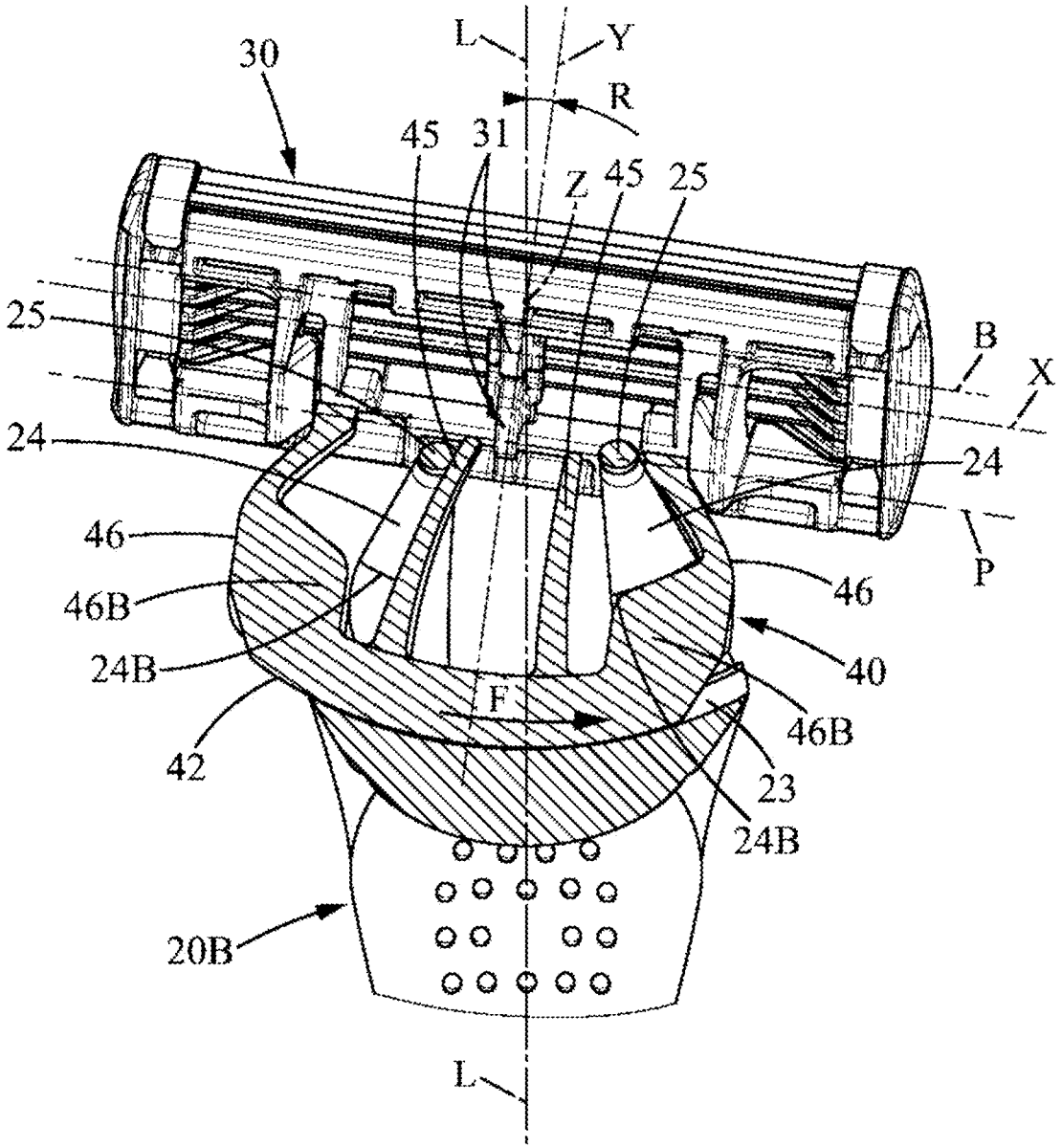
FIG. 5B shows a partial top view of the proximal part of the handle according to the second embodiment with the connector being in an end rotated position.

Referring further to FIG. 2, the handle 20 comprises, at its proximal end 20B, an elongated support 22, 24 and a pair of hooks 21A. Two examples of elongated support 22, 24 are disclosed, a beam support 22 and a platform support 24. FIGS. 2, 3, 4A-4B show the embodiment provided with the beam support 22, whereas FIGS. 5A-5B show the embodiment provided with the platform support 24. The elongated support 22, 24 is positioned at the lower face 20D of the handle 20 and extends therefrom, while the pair of hooks 21A is disposed at the upper face 20C of the proximal end 20B of the handle 20 and extends therefrom. The hooks 21A are provided on each side of the proximal end 20B of the handle 20. In some alternative embodiments, more than two hooks 21A could be provided along the upper edge of the proximal end 20B of the handle 20, for example three or four.

The connector 40 is adapted for attaching the cartridge 30 to the proximal end 20B of the handle 20. For this purpose, the connector 40 is formed by a pair of arms 46. The arms 46 extend substantially between the handle 20 and the cartridge 30. Each arm 46 has an end 46A, which may be constructed as a shell bearing, i.e. as holder having a rounded surface. The ends 46A of the arms 46 can be seen as defining an imaginary line P. The line P spans between the ends 46A of the arms 46 and creates an imaginary connection between the two ends 46A of the arms 46. In an embodiment, the pivot axis X is defined as an axis, which is parallel to the line P connecting the ends 46A of the arms 46.

The handle system may further comprise a rocking axis Z, which is transverse to the line P connecting the ends 46A of the arms 46, such that the connector 40 is movably attached along the rocking axis Z (best visible in FIG. 1, 2, or 6) to the handle 20. The direction of rotation of the connector 40 about the rocking axis Z is labeled with the double-arrow F shown of FIG. 1. The connector 40 is adapted to be rotated in each of the two directions illustrated by the arrow F.

The connector 40 extends in a plane PY, defined by the line P and a connector axis Y. Line P connects the ends 46A of the arms 46. With the connector 40 in neutral non-rotated position, the connector axis Y is identical with the longitudinal handle direction L. When the connector 40 is rotated around the rocking axis Z in the direction of the arrow F, the connector axis Y forms an angle R with the longitudinal handle direction L. This is illustrated in FIGS. 4B and 5B. The intersection of the longitudinal handle direction L and the connector axis Y is the point, where the rocking axis Z is located (see FIGS. 4B, 5B). The pair of arms 46 may extend in a common plane PY as illustrated in FIGS. 4A, 4B, 5A and 5B.

In some embodiments, the cartridge 30 is adapted to perform a movement from a non-pivoted position up to an extreme pivoted position. The extreme pivoted position of the cartridge 30 may correspond to rotation about a pivot angle A up to 40° (and could equal for example to 20°, or 30°). The pivot angle A is a difference angle between the non-pivoted and the extreme pivoted position of the cartridge 30, corresponding to the rotation about the pivot axis X.

The above definition of the pivot axis X includes various possible positions of the pivot axis X. The pivot axis can be located, such that it intersects the inside of the cartridge 30, or it may lie outside the cartridge body in front of the blade edges 35A, such that it lies substantially within the surface of the skin during shaving. The pivot axis X may be parallel with the shaving plane. The pivot axis X lies close to the shaving plane or is part of the shaving plane. The pivot axis X may be identical with a blade edge axis B. The rocking axis Z may also be perpendicular to the pivot axis X.

Throughout the present paragraph reference is made to the cartridge 30 in the neutral non-pivoted position. In this situation, the rocking axis Z may be parallel with the shaving plane S, or may be included in the shaving plane S. Alternatively, the rocking axis Z may form an angle with the shaving plane S. When the cartridge is not pivoted about the pivot axis X, the rocking axis Z may intersect two or more blade edge axes B, where two or more blades 35 are provided in the cartridge 30. The pivot axis X and the rocking axis Z may intersect each other. This point of intersection of the pivot axis X and the rocking axis Z can lie in the shaving plane S. In some embodiments, the point of intersection of the pivot axis X and the rocking axis Z may be located on a blade edge axis B. In other embodiments, the intersection of the pivot axis X and the rocking axis Z may lie above or below the shaving plane S (the shaving plane being defined in FIG. 9). In some embodiments, the rocking axis Z can penetrate the body of the cartridge 30, or it can lie outside the cartridge body in front of the blade edges 35A. The rocking axis Z may intersect two or more blade edge axes B, if two or more blades 35 are provided in the cartridge 30. The rocking axis Z may alternatively lie in the plane formed by the guard 33 and the cap 34. The rocking axis Z is perpendicular to the common plane PY in which the arms 46 extend.

The rocking axis Z, however, may also form an angle with the plane PY taking into account slight allowable variations in the position of the rocking axis Z. For example, the right angle between the rocking axis Z and the plane PY could be varied by about 2°, 4°, 6°, or 8°, as it is applied on true position tolerancing for axis placement in the Geometric, Dimensioning and Tolerancing (GD&T) standards.

Figure 10A:
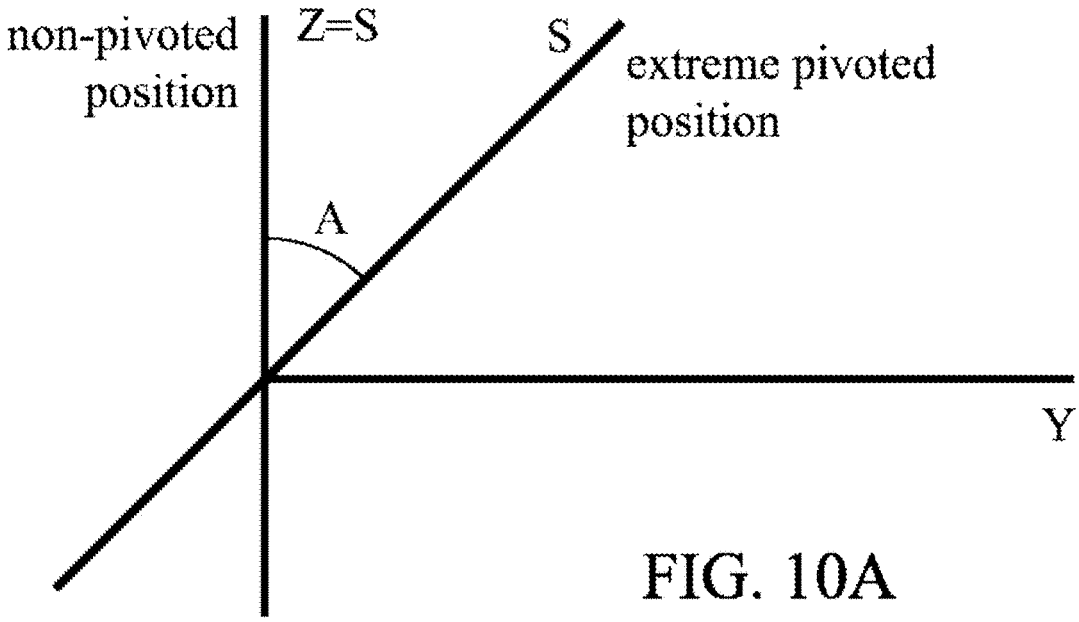
FIGS. 10A-10C show relative positions of the rocking axis Z and the shaving plane in the non-pivoted position of the cartridge and the extreme position of the cartridge according to various embodiments of the present disclosure.
Figure 10B:
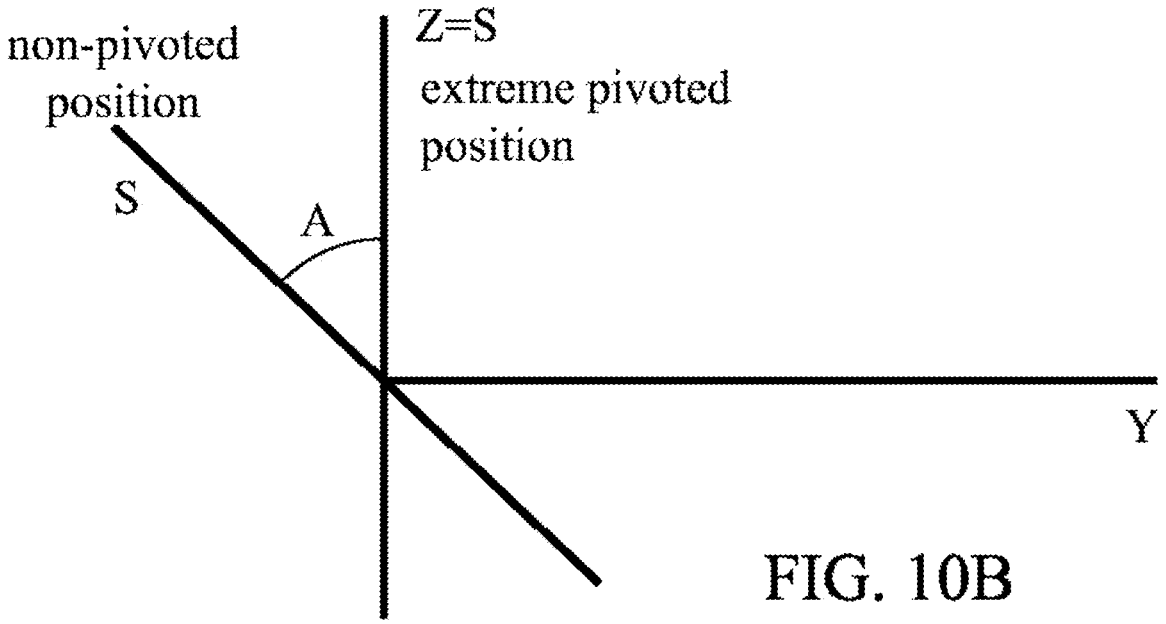
Figure 10C:
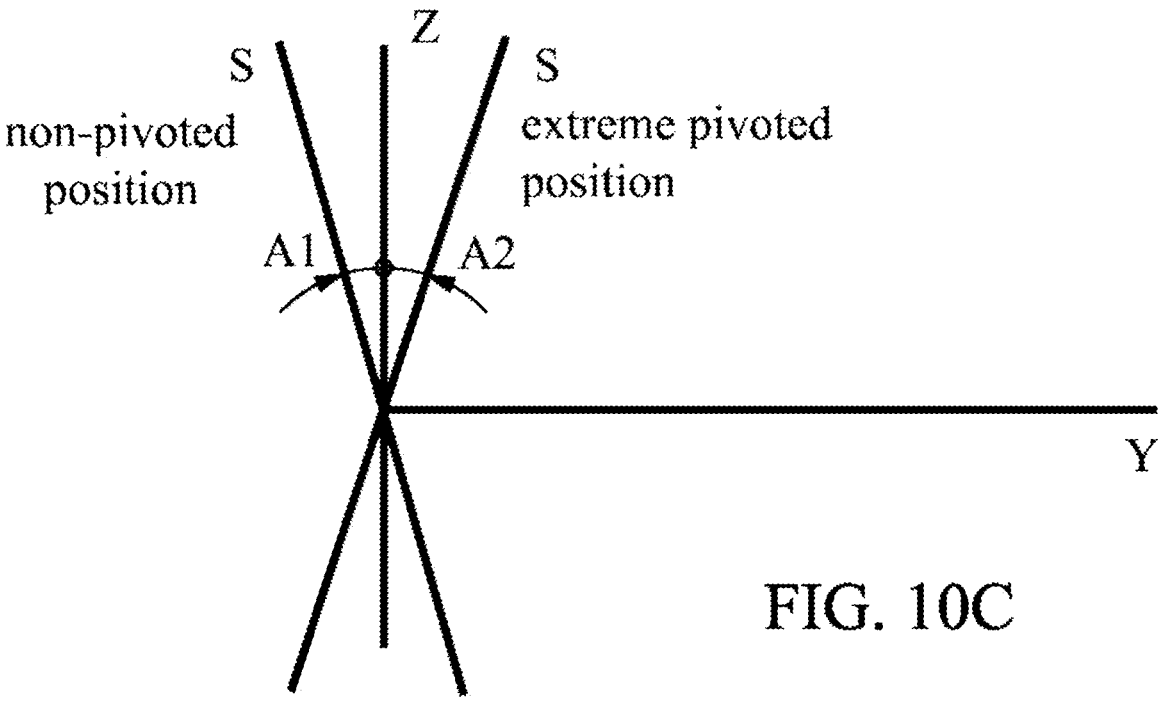

As shown in FIG. 10A-10C, there are three possible configurations of the rocking axis Z with respect to the shaving plane S.

FIG. 10A shows an arrangement, where the rocking axis Z lies within the shaving plane S, when the cartridge 30 is in the non-pivoted position. The cartridge 30 may rotate about the pivot axis X along the pivot angle A, which could be 20°, 30° or 40°. In this embodiment, the rocking axis Z and the shaving plane S of the cartridge 30 in the extreme pivoted position form an angle equal to the pivot angle A (maximum angle around which the cartridge 30 can be pivoted). Also, in this embodiment, since the rocking axis Z is perpendicular to the plane PY, the shaving plane S is perpendicular to the plane PY in the non-pivoted position. Then, if the pivot angle A is equal to 40°, the shaving plane S forms and angle of 50° with the plane PY, when the cartridge 30° is in the extreme pivoted position.

FIG. 10B shows an alternative arrangement between the rocking axis Z and the shaving plane S. Here, the rocking axis Z lies within the shaving plane S, when the cartridge 30 is in the extreme pivoted position. Thus, in the extreme pivoted position of the cartridge 30, the shaving plane S and the plane PY form the right angle. If the pivot angle A is equal to 40°, then in the non-pivoted position of the cartridge 30, the shaving plane S forms an angle of 130° with the plane PY.

Both embodiments of FIGS. 10A and 10B could be used with various shapes of the handle 20.

FIG. 10C shows an embodiment, where the rocking axis Z lies in between the locations of the shaving plane S corresponding to the non-pivoted position and the extreme pivoted position of the cartridge 30. Between the shaving plane S in the non-pivoted position and the rocking axis Z, there is formed a first angle A1. Between the shaving plane S in the extreme rotated position and the rocking axis Z, there is formed a second angle A2. By definition, A1+A2=A. The rocking axis Z lies exactly in the middle of the angle between the non-pivoted position and the extreme pivoted position, i.e. A1=A2. The sum of the first angle A1 and the second angle A2 could be for example 40°. In an embodiment, the first angle A1 and the second angle A2 are both 20°. However, favorable results have also been achieved when testing such a configuration, where the second angle A2 lies anywhere between 0° and A/2°, for example, the second angle A2 could be 5°, 10° or 15°.

The cartridge 30 further includes one or two cams 31, or cam surfaces, adapted to cooperate with a central elastic tongue 44. The central elastic tongue 44 generates biasing force acting on the cartridge 30, when the cartridge 30 is pivoted about the pivot axis X, thus forcing the cartridge 30 to return to a non-pivoted position. The non-pivoted position corresponds to such a position of the cartridge 30, where no shaving forces are applied thereto, and where the cartridge 30 is not pivoted with respect to the pivot axis X, such that the cartridge 30 is in a neutral state. The cartridge 30 in the non-pivoted position is illustrated for example in FIG. 6.

As can be seen in FIG. 2, the connector 40 further includes an arcuate face 42 interconnecting the two arms 46. The arcuate face 42 extends substantially along the width WH of the proximal end 20B of the handle 20 and is adapted to maintain contact therewith. The arcuate face 42 lies substantially in the same common plane PY as the two arms 46. Each arm 46 is disposed on one side of the connector 40 and extends from the side adjacent to the handle 20 forwardly towards the cartridge 30. The arms 46 may or may not be straight. For example, the arms 46 may curve towards the middle of the connector 40. Alternatively, the arms 46 may curve downwards or upwards in order to reflect the general shape of the handle 20. At the end 46A of each arm 46 is located a shell bearing for attaching the cartridge 30 to the connector 40 via the pair of looped hooks 32 located on the cartridge 30.

From the center part of the arcuate face 42 forwardly towards the cartridge 30 extends a central tongue 44. The central tongue 44 extends generally parallel with the two arms 46 and is located in the middle between the two arms 46. Adjacent to the central tongue 44, there extend two lateral tongues 45. The central tongue 44 lies in the same plane PY as the two arms 46. It may also lie above or below this plane PY, being substantially parallel to this plane PY. The lateral tongues 45 are located between the central tongue 44 and the corresponding arm 46. Each lateral tongue 45 extends forwardly from the arcuate face of the connector 40 toward the cartridge 30. The lateral tongues 45 extend generally in the same direction as the two arms 46 and the central tongue. The lateral tongues 45 can be shorter than the central tongue 44. The length of the lateral tongues 45 ranges between 50-90% of the length of the central tongue 44. The lateral tongues 45 may be located either in the same plane PY as the arms 46, or in a plane extending below the plane PY. Each lateral tongue 45 is made from elastic material such that flexing of the lateral tongue 45 is possible. The elastic material could be for example plastic.

The connector 40 may comprise reinforcing ribs 46B protruding from each arm 46 towards the center of the connector 40, where the elastic tongues 44, 45 are located. The reinforcing ribs 46B may extend along most of the length of the arms 46. The reinforcing ribs 46B span along 30-90% of the length of the arms 46. The reinforcing ribs 46B may have the same length as the lateral tongues 45. For example, the reinforcing ribs 46B may be half of the length of the arms 46. The connector 40 may also include a stud 43 protruding upwards from the central portion of the arcuate face 42. The sides of the connector 40 may be symmetrical with respect to a plane of symmetry passing through the central tongue 44. This plane of symmetry can be transverse to the plane PY.

Figure 3:
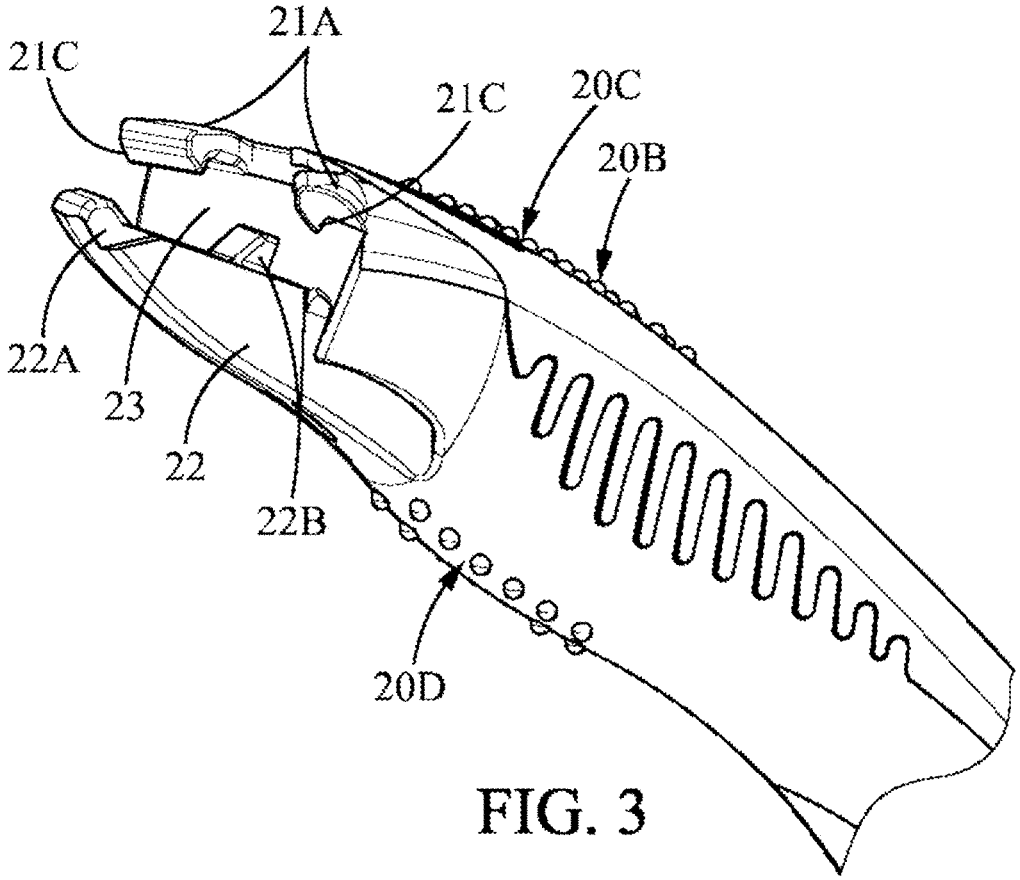
FIG. 3 shows a partial view of the proximal part of the handle of the shaver of FIG. 1.

Referring to FIG. 3, the proximal end 20B of the handle 20 further comprises an oval depression 23 extending across the width WH of the handle 20. The oval depression 23 has a round concave shape curving inwardly into the proximal end 20B of the handle 20. The oval depression 23 has a shape complementary to the shape of the arcuate face 42 of the connector 40, so that the oval depression 23 fits closely to the arcuate face 42. In other words, the arcuate face 42 matches side to side with the shape of the oval depression 23. This feature is best apparent from FIGS. 2, 4 and 5, and also from the cross-sections of FIGS. 7 and 8. The oval depression 23 and the arcuate face 42 are adapted to slide with respect to each other, thus creating a rotational movement of the connector 40 around a rocking axis Z best seen in FIG. 1, 2, or 6. The cartridge 30 and the connector 40 may be attached to each other such that they are rotated simultaneously around the rocking axis Z, as the shaving forces are applied to the cartridge 30. The connector 40 is adapted to rotate to one side into a first end position, or the other side to a second end position. The cartridge 30 may also rotate between a first end position and a second end position.

Generally, the elongated support 22, 24 extends from a portion of the proximal end 20B of the handle 20, such that it supports the connector 40 from below, while the pair of hooks 21A support the connector 40 from above. The elongated support 22, 24 extends from lower face 20D of the proximal end 20B of the handle 20. The elongated support 22 may have a beam shape, which can be seen in FIG. 2, 3, or 4A-4B. The elongated support 22 may be further provided with a block 22B. The block 22B fixes the connector 40 to the handle 20 and prevents any loose movements. More particularly, the block 22B prevents the arcuate face 42 of the connector 40 from sliding forward (i.e. away from the proximal end 20B of the handle 20) and allows the arcuate face 42 to maintain contact with the oval depression 23. According to one possible embodiment, the beam support 22 further comprises a deflector 22A, which forms the tip of the elongated support 22 and curves upward. The hooks 21A each comprise a protrusion 21C extending downward from the hooks 21A. Similar to the function of the block 22B, the protrusions 21C are also adapted to secure the connector 40, and especially the arcuate face 42 of the connector 40, to the proximal end 20B of the handle 20.

In an alternative embodiment, the elongated support 24 may have a platform shape, such as that in FIGS. 5A-5B. The elongated support 24 can be provided in pair, each one protruding forwardly towards the cartridge 30 from one side of the proximal end 20B of the handle 20. Each of the elongated supports 24 can comprise a pin 25 pointing upward. The pin is located at the end of the elongated support 24. Depending on the length of the lateral tongues 45, the pin 25 may be located anywhere between the end and the middle of the length of the elongated support. The pin 25 can also be used in the embodiment where the singly elongated support 22 extends from the middle of the width WH of the proximal end 20B of the handle. There can also be a step 24B substantially in the middle of the length of each elongated support 24. The step 24B divides the platform in two parts, one part having its surface lying below the surface of the other part, both surfaces being substantially parallel. Each step 24B can be adapted to engage with the corresponding reinforcing rib 46B, so as to fix the connector 40 in place, allowing only for the swiveling movement of the connector 40 with respect to the handle 20. The steps 24B of each elongated support 24 engaging with the reinforcing ribs 46B serve similar function as the block 22B of the beam support 22 engaging with the arcuate face 42.

The beam support 22 and the platform support 24 are only given examples and may be modified, or the features pertaining to one type of support may appear on the other type of elongated support and may be combined with other features. For example, the deflector 22A of the beam support 22 may be replaced with a pin 25 of the platform support 24, since they serve a similar function. The beam support 22 may be provided in pair and can extend from the sides of the handle 20, instead of extending from the central part. Similarly, single platform support 24 may extend from the central portion of the proximal end 20B. Similarly, the reinforcing ribs 46B cooperating with steps 24B, or the block 22B cooperating with the arcuate face 42 could appear on either type of the elongated support. In some embodiments, the number of elongated supports can be three (extending from the sides and from the center) or more.

The elongated support 22, 24 may have a width WB, WP. The width WB, WP of the elongated support 22, 24 is not greater than one third of the width WH of the proximal end 20B of the handle 20. The width WH of the proximal end 20B of the handle is taken along the line P connecting the ends of the arms 46. Since the line P may rotate together with the connector 40, the width WH is taken along the line P, when the connector is in non-rotated position. For example, the width WB, WP of the elongated support 22, 24 could be one fourth of the width WH of the proximal end 20B. Similar arrangements are possible with regard to the width (not showed on the drawings) of the hooks 21A. The hooks 21A should be no wider than one third of the width WH of the proximal end 20B, for example can have the width about one fourth of the width WH of the proximal end 20B.

The disclosure provides means for rotating the cartridge 30 around two pivot axes by using simple mechanical components and ensures quality of the movement by increasing its smoothness, thereby leading to a better shaving experience. The two different pivotal movements should be independent from each other. This also applies to biasing forces applied, when the cartridge 30 is being returned to the non-pivoted (referring to the pivoting about the pivot axis X) and/or non-rotated position (referring to the rotation about the rocking axis Z). In other words, these biasing forces should also be independent of each other.

The arcuate face 42 of the connector 40 is adapted to swivel along the oval depression of the handle 20, such that the connector 40 rotates with respect to the handle 20 around the rocking axis Z, as the shaving forces are applied to the cartridge 30. In general, the elongated support 22, 24 comprises deflecting means. The connector 40 comprises two lateral tongues 45 extending in a direction substantially perpendicular to both the pivot axis X and the rocking axis Z. The lateral tongues 45 abut the deflecting means, such that when the cartridge 30 is rotated in a first direction around the rocking axis Z, one of the two lateral tongues 45 is flexed by the deflecting means, and such that when the connector 40 is rotated in a second direction around the rocking axis Z, the other of the two lateral tongues 45 is flexed by the deflecting means. The flexion of each of the lateral tongues 45 generates biasing force returning the rotated connector 40 into the non-rotated position. Since the cartridge 30 and the connector 40 are attached to one another, the rotation of the connector 40 is in each case accompanied with the corresponding rotation of the cartridge 30. The central tongue 44 and each of the lateral tongues 45 are separated and independent of each other.

The next paragraphs will describe the rotational movement of the connector 40 around the rocking axis Z, when the handle 20 is provided with an elongated support 22 extending from the middle of the width WH of the proximal end 20B of the handle 20, corresponding to FIGS. 4A-4B.

The elongated support 22 of FIGS. 4A-4B comprises an upwardly protruding block 22B for fixing the connector 40 to the handle 20. In this case, the deflecting means are in the form of a deflector 22A forming an end of the elongated support 22, the end being curved in the upward direction. For clarity reasons, the cartridge 30 is not shown in FIGS. 4A-4B. In the original position, when no shaving forces are applied to the cartridge 30, the mutual configuration of the individual elements with respect to each other is as illustrated in FIG. 4A. The left lateral tongue 45 of FIG. 4A abuts closely the deflector 22A from left. The right lateral tongue 45 of FIG. 4A abuts closely the deflector from right. It can be seen that once the connector 40 starts to swivel in one of the directions labeled with the arrow F, with respect to the handle 20, as the shaving forces emerge, one of the lateral tongues 45 is flexed (i.e. deflected from its original position) by the deflector 22A. The function of each lateral tongue 45 is to exert biasing force through the deflector 22A on the handle 20, in order to force the connector 40 back to its original non-rotated position as illustrated in FIG. 4A. The non-rotated position refers to such a position, when the connector 40 is not rotated around the rocking axis Z. Due to their mutual interconnection, in the non-rotated position neither the connector 40, nor the cartridge 30 are rotated about the rocking axis Z.

FIG. 4B show the connector 40 rotated to the left side (i.e. the arcuate face 42 of the connector 40 slides to the left with respect to the oval depression 23 of the handle 20), which results in the right elastic tongue 45 being flexed to the right. In this situation, the right elastic tongue exerts a non-zero force back onto the deflector 22A, such that the connector 40 is rotated back to the right, as soon as the shaving forces vanish. The connector rotates in the direction of the arrow F as shown in FIG. 4B. When the connector 40 is rotated to the right, by way of the applied shaving forces, the left lateral tongue 45 is flexed and returns the connector 40 back into the non-rotated position, as soon as the shaving forces cease to exist. FIG. 4B shows the connector 40 in a partially rotated position (full line), in comparison to the non-rotated position (dashed line). FIG. 4B also shows the connector 40 in an end rotated position (dash-dotted line). In the end rotated position the connector 40 is rotated to such an angle that the stud 43 contacts one of the two hooks 21A. FIG. 4B shows the stud 43, which protrudes upwardly from the central part of the arcuate face 42 and prevents the connector 40 from being rotated further. The connector 40 is adapted to rock from a rest position to a first end position or a second end position. In the first end position the rocking of the connector 40 is stopped by the stud coming into contact with a first of the pair of hooks 21A. In the second end position the rocking of the connector 40 is stopped by the stud 43 coming into contact with a second of the pair of hooks 41A. Similar is the function of the stop portions 42, which are depicted in FIG. 2. The stop portion 41 may be located on the bottom of the arcuate face 42 of the connector 40. The stop portions 41 may dispose at opposite ends of the arcuate face 42. The stop portions 41 may protrude downwardly from the arcuate face 42. As the connector 40 rotates either to the left or to the right, one of the stop portions 41 contacts the elongated support 22 in the middle of the width WH of the proximal end 20B of the handle 20 and prevents the connector 40 from being rotated further. The stop portions 41 may not be used, when an elongated support is disposed at a different place than in the middle of the proximal end 20B. However, the use of the stud 43 is still possible even in those cases.

As illustrated in FIG. 4B, when the connector 40 is in the end rotated position and the stud 43 contacts one of the hooks 21A, the connector 40 can only be rotated in one direction. This direction is illustrated by the singe arrow F.

In the non-rotated position, the angle R between the connector axis Y and the longitudinal handle direction L is equal to zero (viewed from a top view). Depending on the embodiment, the angle R in an end rotated position could range from 10° to 45°. For example, values of the angle R corresponding to the end rotated position may be, for instance, 20° or 30°.

FIG. 5A shows another embodiment, where two platform supports 24 extend forwardly from each side of the proximal end 20B of the handle 20. The elongated supports 24 each comprise an upwardly protruding step 24B extending along the entire width of the elongated support 24 and adapted to fix the connector 40 to the handle 20 by engaging with a portion of each arm 46. The step 24B could be engaged with a corresponding reinforcing rib 46B. The deflecting means can be in the form of a pin 25 located at the end of each elongated support 24. The pins 25 protrude in the upward direction. Further, FIG. 5A shows an initial position of the connector 40, the cartridge 30 and the lateral tongues 45. For clarity reasons, the central tongue 44 is omitted from FIGS. 5A-5B. In the initial position, when no shaving forces are applied, the lateral tongues 45 are in a relaxed position (i.e. under no tension) and the connector 40 is in the non-rotated position. The left lateral tongue 45 abuts the pin 25 of the left elongated support 24 from the right. The right lateral tongue 45 abuts the pin 25 of the right elongated support 24 from the left.

In the non-rotated position of FIG. 5A, the connector 40 can be rotated in any of the directions illustrated by the double-arrow F.

FIG. 5B shows a situation, when due to the presence of the shaving forces the connector 40 is rotated towards the left side. This rotation causes the left lateral tongue 45 to flex, as it is forced to bend to the right by the corresponding pin 25 of the left elongated support 24. Once the shaving forces disappear, the left elastic tongue 45, which is under the tension, exerts biasing force to the corresponding pin 25, thus rotating the connector 40 back into the non-rotated position. During the rotational motion of the connector 40, the reinforcing ribs 46B are engaged with the corresponding step 24B in the elongated supports 24. As apparent from the FIG. 5B, when the connector 40 is fully rotated, one of the reinforcing ribs 46B may lose contact with, and therefore disengage from the corresponding step 24B. Firm attachment of the connector 40 to the handle 20 is then ensured by the other reinforcing rib 46B being fully engaged with the corresponding step 24B of the other elongated support 24 of FIG. 5B. Attaching the connector 40 to the handle 20 only by means of reinforcing ribs 46B of the arms 46 and steps 24B on the elongated supports is not suitable, when a single support is used in the middle of the proximal end 20B of the handle 20, since the rotation of the connector 40 with respect to the handle 20 would cause total disengagement of the connector 40 from the handle 20.

FIG. 5B shows the connector 40 in an end rotated position. This situation occurs when one of the arms 46 meets with the corresponding portion of the platform support 24. Then the rotation of the connector 40 is stopped. The connector 40 then can be rotated only in one direction illustrated by the arrow F in FIG. 5B. When the connector 40 is in the end rotated position (with respect to the handle 20), the connector axis Y and the longitudinal handle direction L form an angle R. The angle R corresponds to the maximum rotation of the connector 40 with regard to the handle and can lie anywhere between 10-40°, for example the angle is 20°, or 30°.

In both embodiments of FIGS. 4A-4B and 5A-5B, lateral tongues 45 are adapted to exert return torque on the connector 40. More particularly, in the embodiment of FIGS. 4A-4B the return torque is exerted on the connector 40 via acting on the deflector 22A, and in the embodiment of FIGS. 5A-5B, the return toque is exerted on the connector 40 via acting on the corresponding pin 25. The return torque generated by each lateral tongue 25 lies between 0 and 30 Nmm, between 10 and 30 Nmm in some instances, and between 15 and 25 Nmm in others. The return toque exerted by lateral tongues 45 decreases, as the connector 40 is rotated to either side. The increase of the return toque may depend on the angle R either linearly or non-linearly. The increase of the return toque per degree may lie between 0.5 Nmm and 2 Nmm, between 0.67 Nmm and 2 Nmm in some instances, and between 1 and 1.67 Nmm in others.

In both embodiments of FIGS. 4A-4B and 5A-5B, the connector 40 comprises a central tongue 44 extending in a direction substantially perpendicular to both the pivot axis X and the rocking axis Z, such that the tip of the central tongue 44 contacts cam surfaces 31 on the backside of the cartridge 30. The central tongue 44 is adapted to flex as the cartridge 30 is pivoted about the pivot axis X, such that the central tongue 44 exerts a biasing force to the cartridge 30, when the cartridge 30 is pivoted around the pivot axis X, thus returning the cartridge 30 to a non-pivoted position. Alternative embodiments having only the rocking axis Z without the presence of the pivot axis X are also possible, since the two rotational movements are designed to be independent of each other.

Figure 7:
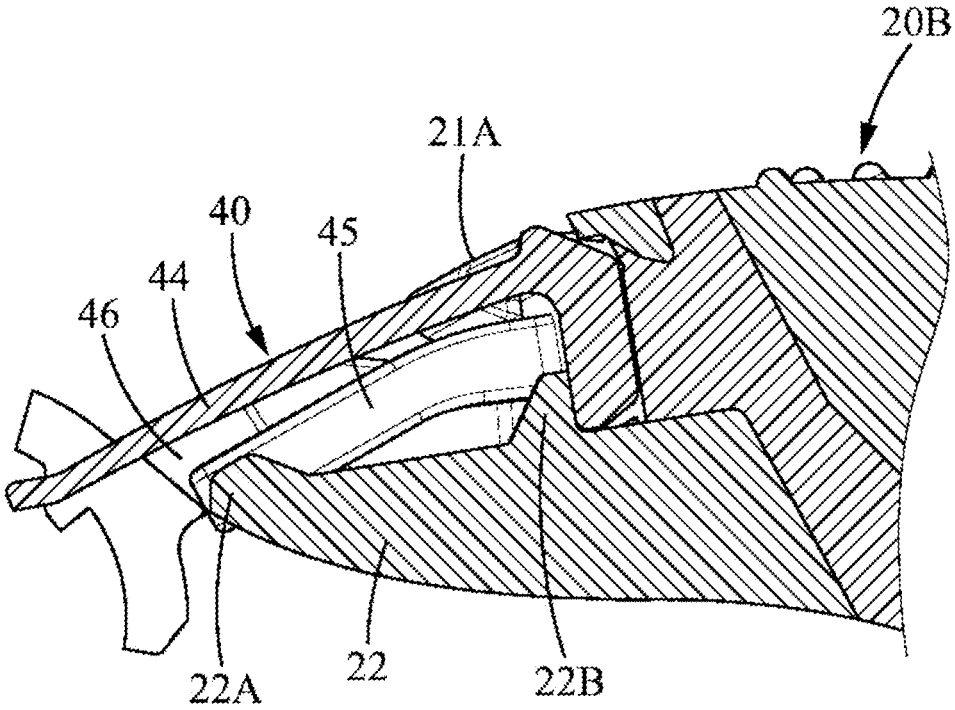
FIG. 7 is a cross section along line VII of FIG. 4A.
Figure 8:
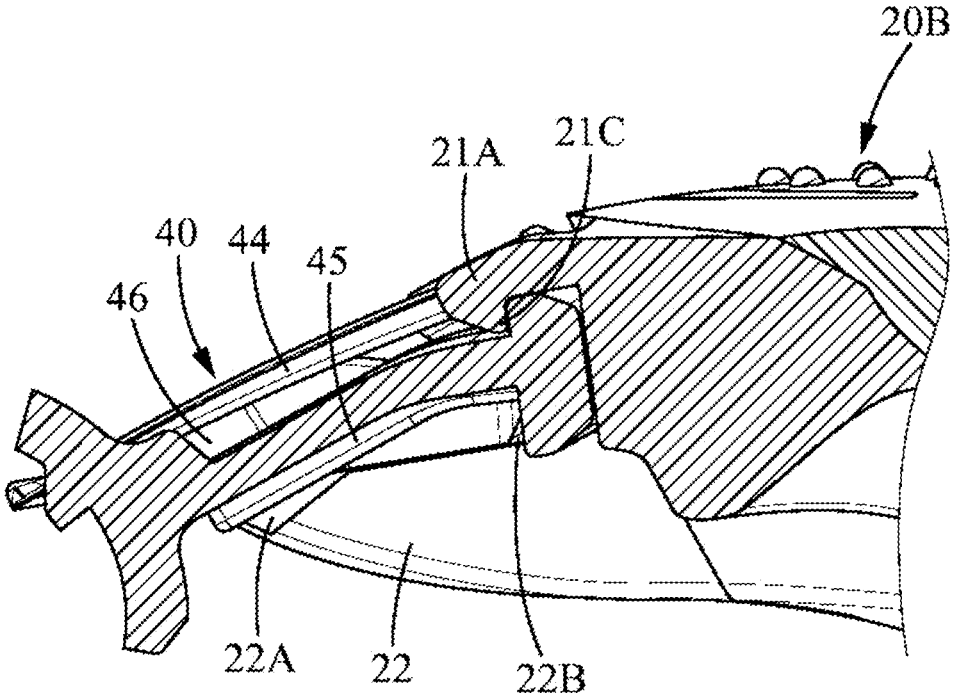
FIG. 8 is a cross section along line VIII of FIG. 4A.

FIGS. 7 and 8 show two cross-sections through the connector 40 and the proximal end 20B of the handle 20. FIG. 7 illustrates how the connector 40 is supported by the elongated support 22 from below, and how the connector 40 is locked in position by the block 22B. In contrast, FIG. 8 shows how the connector 40 is locked in position from above by a hook 21A. FIG. 8 shows an embodiment, in which the central tongue 44 is located above the plane PY formed by the arms 46.

A further embodiment of the present disclosure is described with reference to FIGS. 11, 12A and 12B which features an alternative connector 40, and more particularly a special placement and shape of the lateral tongues 45. The connector 40 of FIGS. 11, 12A and 12B include modifications in structural features of the handle 20 and the connector 40, and will be thoroughly described in the following paragraphs.

Figure 11:
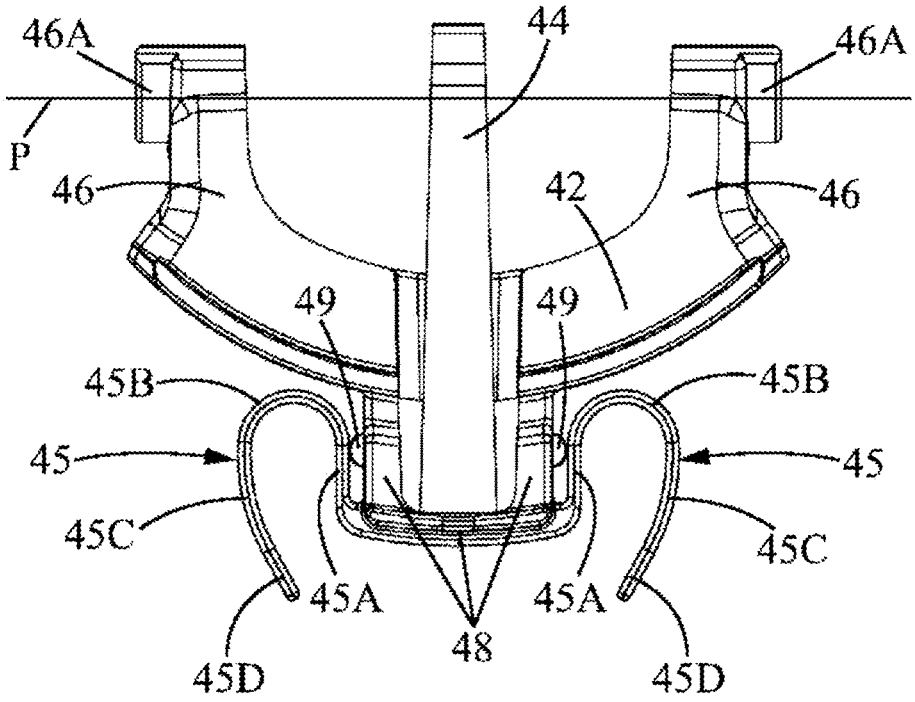
FIG. 11 shows an alternative of a connector suitable for shavers whose cartridges pivot about two axes

FIG. 11 shows a connector 40 to be used in a shaver 10, which allows for the shaving cartridge 30 to be rotated around two axes. Connector 40 as of FIG. 11 facilitates such movement of the cartridge 30. Only differences with respect to the embodiments already described above will be mentioned below. It should be understood that all features of the handle 20, the cartridge 30 and the connector 40 described in the previous text are also applicable for the embodiments of FIGS. 11, 12A, 12B unless different means are described here below.

It is repeated that the connector 40 may include at least two arms 46 for attaching and holding the cartridge 30 at the proximal end 20B of the handle 20. Each arm 46 has an end which may be constructed as shell bearings 46A or any alternative holding means.

The shell bearings 46A facilitate pivotal movement of the cartridge 30 around the pivot axis X. The line between the arms 46 connecting the shell bearings 46A defines line P. At the same time, the connector 40 is adapted for rotational movement around the rocking axis Z as will be described in more detail below. The connector extends in the plane PY, where the Y-axis is a connector axis, which is identical with the longitudinal handle direction when the connector 40 is in the neutral position. The connector axis Y extends through the middle of the connector 40 and represents an axis of symmetry for the connector 40 as of FIG. 11. Nevertheless, the disclosure takes into account that the connector 40 may deviate from strictly symmetrical shape in case the need arises for some applications. Possible orientations and mutual relationships between the axes X, Y, P, and Z are the same as described in the above text. Likewise, the cartridge 30 contains one or more elongated blades 35 extending along the longitudinal direction of the cartridge 30. Each blade 35 has a blade edge 35A extending along blade edge axis B.

According to FIG. 11, the arms 46 may extend substantially parallel and symmetrical to the connector axis Y. The arms 46 may protrude from the connector body 42, which is common support to both arms 46. The connector body 42 may have substantially rounded shape curving towards the handle 20. The curvature of the connector body 42 may correspond to the curvature of the semi-circle along which the connector body 42 moves when the connector 40 rotates along the rocking axis Z. The connector body 42 may face the proximal end 20B of the handle 20. The corresponding face of the proximal end 20B of the handle 20 may have the same curvature as the connector body 42, such that the connector body 42 is allowed to slide along the face of the proximal end 20B of the handle 20.

At the end facing the handle 20, the connector 40 is provided with a holder 48. The holder 48 could be constructed as two lateral walls protruding symmetrically from the connector body 42 towards the handle 20 and connected by a back wall extending in between the two lateral walls. Each lateral wall is parallel with the connector axis Y. Each lateral wall of the holder 48 may be provided with a projection 49, where each projection 49 facilitates rotatable connection with the handle 20. Each projection 49 may slidably fit into a groove 26 positioned at the proximal end 20B of the handle 20 below the holder 48. In FIG. 11, the projections 49 are sketched as a perspective. The projections 49 protrude outwardly from the connector plane PY substantially perpendicularly to the connector plane PY. The groove 26 may extend along a circumference of a circle, such that the rocking axis Z intersects the center of the circle and such that the circle lies in or parallel to connector plane PY. As shaving forces are applied to the cartridge 30, the cartridge 30 and the connector 40 start to move. Due to restricted connection between the groove 26 and the projections 49 only rotational movement is possible around the rocking axis Z.

One of the technical features of the holder 48 is that the overall structure of the connector 40 is such that the body 42 and the arms 46 form a relatively small compact unit substantially outside the handle body. The holder 48 may be the only component of the connector 40 protruding inside the handle body in order to facilitate the connection between the handle 20 and the connector 40. This simplifies the construction and reduces risk of occurrence of faulty product during manufacture or breaking of the shaver 10 during use. Also, the holder 48 not only facilitates connection to the handle 20, but also holds the central tongue 44. The central tongue 44 can protrude as far as from the back wall of the holder 48, thus allowing for the central tongue 44 to be longer. The longer central tongue 44 is more sensitive to the shaving forces applied to the cartridge 30 and lead to more comfortable shaving. Both lateral tongues 45 (which will be more described later) and the central tongue 44 protrude from the same part of the connector 40, namely from the holder 48. This also enables that the central tongue 44 and the lateral tongues 45 are formed as integral part or unit.

According to FIG. 11, there are two lateral tongues 45 extending from the lateral walls of the holder 48. For example, the lateral tongues 45 may extend from the point where a lateral wall of the holder 48 connects the back wall of the holder 48. The lateral tongues 45 may be made from the same material as the holder 48 and both may be moulded as one piece. Also, the entire connector 40 can be moulded as single piece. Alternatively, the lateral tongues 45 may be attached to the holder 48 by suitable attaching means, such as adhesives or snap fitting. The pair of lateral tongues 45 is symmetrical position and structure with regard to connector axis Y. Lateral tongues 45 are made from a suitable material, such as plastic, allowing flexure and bending of the elastic tongues 45 and least in part of a length of the tongue. The main characteristic of the lateral tongues 45 is that the lateral tongues 45 are resilient.

In embodiments, each lateral tongue 45 comprises at least four distinct sections, namely a fixing section 45A, a U-shaped section 45B, a curved section 45C and a tip section 45D respectively as illustrated in FIG. 11.

The fixing section 45A may be rigidly fixed to the holder 48, for example to the edge where the lateral wall and the back wall of the holder 48 connect. The fixing section 45A may extend parallel to the lateral walls of the holder 48 and/or substantially in the direction towards the arms 46 (toward the cartridge 30). The fixing sections 45A can be made from a rigid non-elastic material in order to facilitate better stability of the lateral tongues 45. In that case, only the U-shaped section 45B and/or the curved section 45C can be made elastic.

The U-shaped section 45B is curved such that the bottom of the U-shape faces towards the arms 46. The U-shaped section 45B is made from an elastic resilient material, such as plastic. The ends of the U-shape are respectively adjacent to the fixing section 45A and the curved section 45C. The curved section 45C extends in the opposite direction than the fixing section 45A, i.e. away from the arms 46. Due to the U-shaped section 45B, the lateral tongues 45 have the overall shape of the letter U.

The curved section 45C is curved such that it progressively converges to the connector axis Y, resulting in the end of the curved section adjacent tip section 45D being closer to the connector axis Y than the end of the curved section adjacent the U-shaped section 45B. The curved sections 45C have non-zero curvature, i.e. they both curve towards and converge to the connector axis Y. The curved sections 45C are symmetrical and their curvature is the same. The curved sections 45C are made of an elastic resilient material, such as plastic.

In order to achieve better formability of the lateral tongues 45 and smoother changing of the shape of the lateral tongues 45, the curved portion 45C may have lower modulus of elasticity than the U-shaped portion 45B, i.e. the U-shaped portion 45B could be stiffer when compared to the curved portion 45C.

The tip portions 45D are linear, i.e. having no curvature. The tip portions 45D continuously connect to the respective curved portions 45C and continue to converge toward the connector axis Y (however, unlike in case of the curved sections 45C, this convergence is no longer progressively increasing). In the neutral position of the connector 40 each respective tip portion 45D bears against a post 27. The posts 27 protrude upright from the base of the proximal end 20B of the handle 20 and are positioned substantially symmetrically with regard to the longitudinal handle axis. Similar to the fixing sections 45A, the tip sections 45D can be rigid and non-elastic as opposed to the U-shaped section 45B and curved section 45C, thereby leading to smoother transfer of shaving forces from the rotated cartridge 30 into the deforming portions of the lateral tongues 45. In some embodiments, even the U-shaped section 45B might be rigid and the elasticity of the lateral tongues 45 may lie entirely in the curved sections 45C.

Figure 12A:
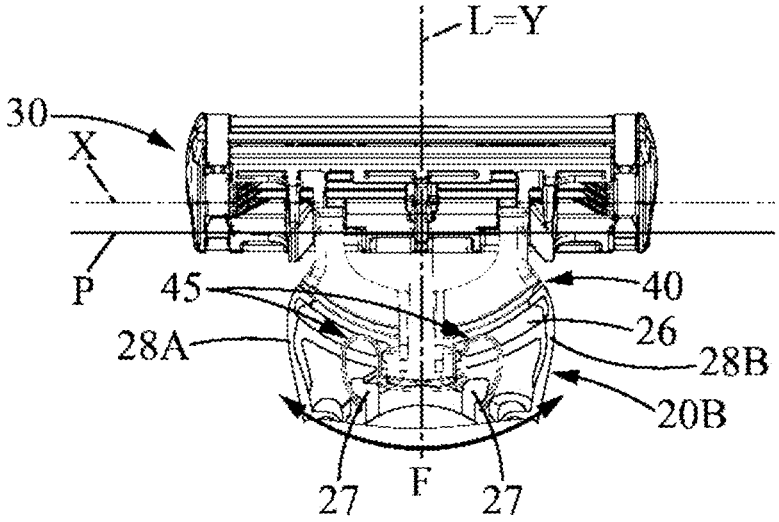
FIG. 12A shows implementation of the connector of FIG. 11 onto a shaver handle, the connector being in the neutral position.

Turning now to the operation of the lateral tongues 45 and with reference to FIG. 12A, in the neutral position both lateral tongues 45 bear against the corresponding post 27. The posts 27 have the same function as the deflecting means described with regard to embodiments of FIGS. 1-10. The posts 27 are another example of deflecting means, similar to the already described deflector 22A and pins 25. The post 27 cause the lateral tongues 45 to flex when the connector 40 is rotated. As described above, it is required that at least one of the U-shaped sections 45B and the curved section 45C is elastic. Embodiment is described below with both sections being elastic. The elastic U-shaped section 45B and the elastic curved section 45C are in a neutral state when the connector 40 is in the neutral position. The double arrow F of FIG. 12A represents that the connector is able to be rotated in two directions.

Figure 12B:
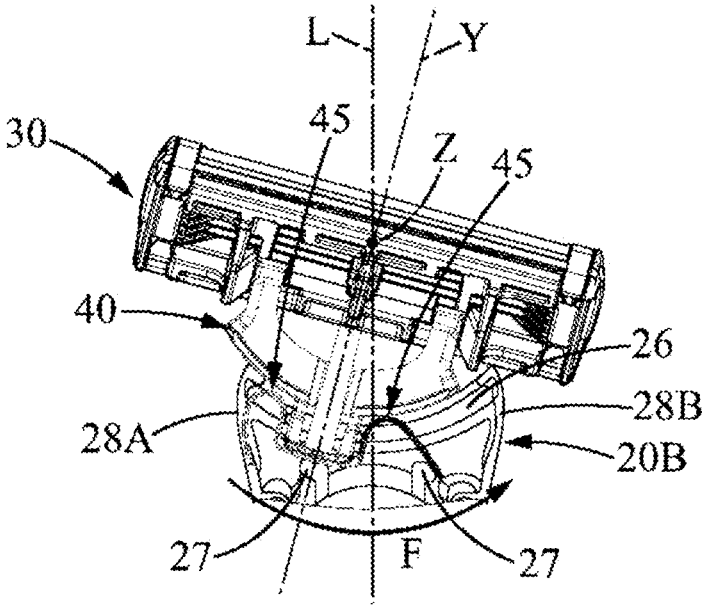
FIG. 12B shows the implementation of the connector of FIG. 11 onto a shaver handle, the connector being in the end rotated position.

Referring to FIG. 12B upon application of shaving forces to the cartridge 30, the forces cause the cartridge 30 and the connector 40 to rotate. In FIG. 12B the connector 40 moved towards the left side of the handle 20. At this point, the curved portion 45C at the right is stretched such that it straightens in the process, thereby generating biasing forces urging the connector 40 towards the neutral position. At the same time, the U-shaped section 45B on the right is also stretched such that it extends and widens in the process. Meanwhile, upon rotation of the connector 40 the lateral tongue 45 on the left moves closer to the left side wall 28A of the handle 20. In the end rotated position as shown in FIG. 12B, the curved portion 45C on the right fully straightens up and causes maximum biasing forces urging the connector 40 back to the neutral position. Also, the U-shaped section 45B on the left is in a fully stretched state (maximally widened) and also causes the return of the connector 40 to the neutral position. Simultaneously, the curved portion 45C on the left may lean against the left side wall 28A of the handle 20, and the corresponding curved portion 45C is then (similar to the one on the opposite side) caused to be stretched (i.e. elastically deformed), but not necessarily such that the curved section 45C would straighten up completely. In that case, deformation of the curved section 45C by the left side wall 28A leads to reduction of the curvature of the curved section 45C with regard to its neutral state and therefore generates resilient forces. The leaning of the curved portion 45C against the left side wall 28A may also cause the corresponding U-shaped section to compress, i.e. the U-shape shrinks and gets narrowed, which also generates further resilient forces. In this case, the left side wall 28A may serve as an additional deflecting means (in addition to the posts 27), and the same applies for the other side wall 28B. The posts 27 may be regarded as first deflecting means and the side walls 28A, 28B may be regarded as second deflecting means, both causing flexure and elastic deformation of the lateral tongues 45.

The provision of the left lateral tongue 45 being adapted to lean against the side wall 28A and generate elastic forces of its own in addition to the elastic forces already generated by the right lateral tongues improves the process of rotation of the connector 40, especially at the end rotated positions. Immediately after the shaving forces are generated, the right lateral tongue stretches and generates biasing forces. As soon as the end rotated position is being approached by the connector 40, the rotation is smoothly decelerated and finally stopped by the left lateral tongue 45 leaning against the left side wall 28A. Due to this mechanism, the stopping of the connector 40 at the end rotated position is not sudden, therefore the user does not sense that the end position has been reached. Instead, the user is provided with the sensation of the cartridge 30 flowing along the skin without experiencing sharp changes in motion. The entire shaving experience is improved, especially the motion of the cartridge 30 is smoother. This is relevant especially when the cartridge 30 is allowed to rotate around two axes, when the cartridge 30 complexly adapts to the shape of the skin of a user. The user does not experience sudden changes in motion of the cartridge 30 and the control of the shaver 10 is better.

The left and right lateral tongues 45 are both adapted to get elastically deformed during rotation of the connector 40, and both contribute to the biasing effect that causes the connector 40 to return to the neutral position. Therefore, all the biasing force is not generated only by one of the pair of the lateral tongues and the biasing force becomes better distributed with the resulting effect contributing to increased smoothness of the rotation of the connector 40.

Specifically, the curved portions 45C can be deformed both by stretching due to the posts 27 and by deformation due to the left side wall 28A of the handle 20. Hence, it should be noted that the entire operation of the mechanisms, as described with reference to FIGS. 12A and 12B, involves the connector 40 being rotated to the other side (i.e. to the right).

The invention claimed is:

1. A connector for attaching a cartridge to a handle, the connector comprising:
- a body;
- a pair of arms connected to the body;
- a holder being connected to the body; and
- a pair of resilient lateral tongues connected to the holder;
- the pair of arms projecting from one side of the body and being adapted to attach the connector to the cartridge;
- the pair of resilient lateral tongues being positioned symmetrically with respect to each other; and
- wherein one of the lateral tongues can flex when the connector is rotated in a first direction, and another of the lateral tongues can flex when the connector is rotated in a second direction that is different than the first direction, and wherein when the one of the lateral tongues flexes when the connector is rotated in the first direction, the another of the lateral tongues simultaneously is adapted to be elastically deformed.

2. The connector according to claim 1, wherein each of the resilient lateral tongues is substantially U-shaped.

3. The connector according to claim 1, further comprising a central tongue engaged with and extending from the holder and between the pair of arms.

4. A connector for attaching a cartridge to a handle, the connector comprising:
- a body;
- a pair of arms connected to the body;
- a holder being connected to the body; and
- a pair of resilient lateral tongues connected to the holder;
- the body extending between the pair of arms;
- the pair of arms projecting from one side of the body and being adapted to attach the connector to the cartridge;
- the pair of resilient lateral tongues being positioned symmetrically with respect to each other; and
- the holder being adapted to attach the connector to the handle, wherein one of the lateral tongues can flex when the connector is rotated in a first direction, and another of the lateral tongues can flex when the connector is rotated in a second direction that is different than the first direction, wherein each resilient lateral tongue includes a fixing section, a U-shaped section, a curved section and a tip section, and wherein the curved section is adapted to stretch into a linear shape during flexing of the lateral tongue in one of the first direction or the second direction.

5. The connector according to claim 1, wherein the connector is made of plastic.

6. The connector according to claim 1, wherein the pair of resilient lateral tongues are made of metal.

7. The connector according to claim 4, wherein when the curved section of each resilient lateral tongue is stretched into the linear shape, the linear shape extends along a line which forms an angle between 0-30 degrees with a connector axis that extends through a middle of the connector and is an axis of symmetry for the connector.

8. A connector for attaching a cartridge to a handle, the connector comprising:

a body;

a pair of arms connected to the body;

a holder being connected to the body; and a pair of resilient lateral tongues connected to the holder;

the body extending between the pair of arms;

the pair of arms projecting from one side of the body and being adapted to attach the connector to the cartridge;

the pair of resilient lateral tongues being positioned symmetrically with respect to each other; and the holder being adapted to attach the connector to the handle, wherein one of the lateral tongues can flex when the connector is rotated in a first direction, and another of the lateral tongues can flex when the connector is rotated in a second direction that is different than the first direction, wherein the connector can rotate in the first and second directions until reaching an end rotated position, and wherein at the end rotated position of the connector at least one of the resilient lateral tongues flexes and the other of the resilient lateral tongues simultaneously is adapted to be elastically deformed.

* * * * *